US006744396B2

(12) United States Patent
Stone et al.

(10) Patent No.: US 6,744,396 B2
(45) Date of Patent: Jun. 1, 2004

(54) SURVEILLANCE AND COLLISION AVOIDANCE SYSTEM WITH COMPOUND SYMBOLS

(75) Inventors: Cyro A. Stone, Peoria, AZ (US); Kathryn W. Ybarra, Surprise, AZ (US); Tom V. Eich, Peoria, AZ (US)

(73) Assignee: Aviation Communication & Surveillance Systems LLC, Phoenix, AZ (US)

( * ) Notice: Subject to any disclaimer, the term of this patent is extended or adjusted under 35 U.S.C. 154(b) by 0 days.

(21) Appl. No.: 10/261,338

(22) Filed: Sep. 30, 2002

(65) Prior Publication Data

US 2003/0137444 A1 Jul. 24, 2003

Related U.S. Application Data

(63) Continuation-in-part of application No. 10/044,734, filed on Jan. 11, 2002, which is a continuation-in-part of application No. 09/909,578, filed on Jul. 20, 2001.

(51) Int. Cl.[7] ..... G01S 13/93; G01S 7/04

(52) U.S. Cl. ..... 342/36; 342/29; 342/30; 342/37; 342/175; 342/181; 342/182; 342/195; 701/300; 701/301; 340/945; 340/961

(58) Field of Search ..... 340/945, 961; 701/117–124, 300, 301; 342/36–51, 175–186, 195, 29–32

(56) References Cited

U.S. PATENT DOCUMENTS 6,262,679 B1 7/2001 Tran
6,271,768 B1 8/2001 Frazier, Jr. et al.
6,278,396 B1 8/2001 Tran
6,308,132 B1 10/2001 Wilson et al.
6,320,579 B1 11/2001 Snyder et al.
6,459,411 B2 * 10/2002 Frazier et al. ..... 340/961
2002/0011950 A1 1/2002 Frazier et al.

OTHER PUBLICATIONS

Author: SC–147 RTCA, Inc.; Title: Minimum Operational Performance Standards for Traffic Alert and Collision Avoidance System II (TCAS 11) Airborne Equipment vol. 1; Dec. 16, 1997; p. 138–161.

* cited by examiner

*Primary Examiner*—Bernarr E. Gregory
(74) *Attorney, Agent, or Firm*—William R. Bachand; Squire, Sanders & Dempsey L.L.P.

(57) ABSTRACT

A surveillance and collision avoidance system provides a presentation of situational awareness information for display that includes a compound symbol for each target spaced at a distance and bearing relative to a host symbol. The target compound symbol includes indicia of (a) whether the target is airborne or on the ground; (b) whether the target is a civil aircraft, a military aircraft identified as a formation member with the host aircraft, or a military aircraft not identified as a formation member with the host aircraft; (c) whether a ground track for the target is unknown, known by passive surveillance, or known by active surveillance; (d) for civil aircraft, whether the target is the subject of no advisory, a traffic advisory, or a resolution advisory; and (e) for a military aircraft, whether the target is the subject of no encroachment advisory, an unintended encroachment advisory, or an intended encroachment advisory. Subsystems selectively use an active or a passive mode of surveillance. In a passive mode, surveillance may rely on information received via a network among formation members and/or unsolicited received signals.

46 Claims, 12 Drawing Sheets

| REF. | SYMBOL | DESCRIPTION |
|---|---|---|
| 910 | | CIRCLE (911) SURROUNDED BY ARROWHEAD (912). ARROWHEAD POINTS ALONG TARGET TRACK. |
| 914 | | CIRCLE (915) SURROUNDED BY SQUARE CROSS (916). |
| 918 | | CIRCLE (919) SURROUNDED BY DIAMOND (920). |
| 922 | | SYMBOL 910 SURROUNDED BY CIRCLE (923). ARROWHEAD POINTS ALONG TARGET TRACK. |
| 926 | | SYMBOL 914 SURROUNDED BY CIRCLE (927). |
| 930 | | SYMBOL 918 SURROUNDED BY CIRCLE (931). |
| 934 | | PENTAGON. |

FIG. 9

| REF. | SYMBOL | DESCRIPTION |
|---|---|---|
| 940 | | SYMBOL 910 SURROUNDED BY ARROWHEAD (941). |
| 944 | | SYMBOL 914 SURROUNDED BY SQUARE CROSS (945). |
| 948 | | SYMBOL 940 SURROUNDED BY DIAMOND (949). |
| 952 | | SYMBOL 940 SURROUNDED BY CIRCLE (953). |
| 956 | | SYMBOL 944 SURROUNDED BY CIRCLE (957). |
| 960 | | SYMBOL 948 SURROUNDED BY CIRCLE (961). |
| 964 | | PENTAGON 934 SURROUNDED BY PENTAGON (965). |

FIG. 10

SURVEILLANCE AND COLLISION AVOIDANCE SYSTEM WITH COMPOUND SYMBOLS

CROSS-REFERENCE TO RELATED APPLICATIONS

This is a continuation-in-part application and claims benefit under 35 U.S.C. §120 from related, copending, U.S. patent application Ser. No. 10/044,734 entitled "Integrated Surveillance Display", filed Jan. 11, 2002, which is a continuation-in-part of U.S. patent application Ser. No. 09/909,578 entitled "Formation Surveillance And Collision Avoidance", filed on Jul. 20, 2001.

BACKGROUND OF THE INVENTION

The invention relates to symbols used to prepare a presentation for display for traffic surveillance and collision avoidance systems, for example, in aircraft flying in a formation.

Presently, most aircraft utilize systems that provide pilots information to avoid potential collisions in the air and/or on the ground. There are many varieties of collision avoidance systems (CAS) and conflict detection systems in aircraft. Generally, typical modes of operation fall into the following categories: (1) passive modes of operation; and (2) active modes of operation. A system operating in a passive mode collects information about the position of nearby aircraft by receiving unsolicited messages (e.g., squitters) and by eavesdropping on the replies to the interrogation signals generated by other nearby systems that are operating in an active mode. Active collision avoidance systems transmit signals from the host aircraft to determine relevant information about nearby aircraft, and/or to provide information about the host aircraft to nearby aircraft. The most prevalent active system used in the U.S. today, is the Traffic Alert and Collision Avoidance System (TCAS) as described, for example, in DO-185A "Minimum Operational Performance Standards for Traffic Alert and Collision Avoidance System II (TCAS II)" available from RTCA Inc. TCAS is internationally known as Airborne Collision Avoidance System (ACAS).

TCAS offers pilots of civil and military aircraft reliable information to track traffic and avoid potential collisions with other aircraft. A conventional TCAS installation in an aircraft includes several airborne devices that cooperate. These devices generally operate independently of ground-based Air Traffic Control (ATC) systems. Since TCAS inception, three different control levels have evolved: TCAS I is intended for commuter and general aviation aircraft and provides a proximity warning only, assisting the pilot in visually acquiring intruder aircraft; TCAS II is intended to provide pilots with traffic advisories and resolution advisories in the vertical plane; and TCAS III, which has yet to be approved by the FAA, is intended to provide resolution advisories with horizontal as well as vertical flight paths. TCAS as used herein includes any of these control levels.

TCAS transmits interrogation signals (e.g., ATCRBS Mode C or Mode S signals) and detects the presence of nearby aircraft equipped with transponders that reply to the interrogation signals. When nearby aircraft are detected, TCAS tracks and continuously evaluates the potential of these aircraft to collide with the host aircraft.

For surveillance, TCAS interrogation signals (i.e., interrogations) are transmitted over an interrogation channel (e.g., 1030 MHz) from the TCAS equipped host aircraft. Each interrogation requests a reply from one or more transponder-equipped aircraft within range of the host aircraft. The reply or replies typically include pertinent position and/or intent information of the replying aircraft. Transponder-equipped aircraft within range of the transmitted interrogation reply over a reply channel (e.g., 1090 MHz). The reply may further include altitude, position, bearing, airspeed, aircraft identification, and other information of the replying aircraft to assist the TCAS on the host aircraft in tracking and evaluating the possibilities of collision between the host aircraft and the replying aircraft.

TCAS performs surveillance, tracking, and collision avoidance advisory functions. In operation, a symbol depicting each nearby aircraft is presented on a display located in the cockpit. The displayed symbols allow a pilot to maintain awareness of the number, type, and position of nearby aircraft. An aircraft that is (or is about to be) too close to the host aircraft is called an intruder. TCAS predicts the time to an intruder's closest point of approach (CPA) and a separation distance at the CPA by calculating range, closure rate, vertical speed and altitude. TCAS provides the capability of tracking other aircraft within range, evaluating collision potential, displaying/announcing traffic advisories (TAs), and depending on the type of system used (e.g., TCAS II), recommending evasive action in the vertical plane to avoid potential collisions, otherwise known as resolution advisories (RAs).

In certain circumstances aircraft may not be detected by TCAS, for example, aircraft not equipped with operating transponders cannot reply to interrogations; military aircraft equipped with identification friend or foe (IFF) systems operating in mode 4 do not reply to interrogations; and aircraft that may not receive interrogations (e.g., radio interference, mechanical interference such as when the landing gear interfere with an antenna, or when in a mode of operation called interference limiting).

The Federal Aviation Administration (FAA) sets guidelines for collision warning regions and collision caution regions for implementations of TCAS. A volume of space around the host aircraft defines these regions and/or a time to penetration of that space (e.g., generally referred to as tau ($\tau$)). Examples of a collision region 110, warning region 115, and caution region 150 of a host aircraft 105 equipped with TCAS, are illustrated in FIGS. 1A (top view) and 1B (perspective view). If an aircraft 120 penetrates caution region 150 it may be designated as an intruder and a traffic advisory may be issued to the pilot or crew of host aircraft 105. The TA may consist of an audible warning and visual display indicating the distance and relative bearing to intruder 120. If intruder 122 penetrates warning region 115, a resolution advisory may be issued to the crew or pilot of host aircraft 105. The RA may be corrective or preventive and may consist of instructions to climb or descend at a recommended vertical rate or to refrain from making changes in the present vertical rate.

The shapes, horizontal, and vertical dimensions of the respective regions are a function of the range and closure rate of aircraft 120. The time-space domain for TCAS interrogations is limited in that each interrogation-reply takes a certain period of time. When several different aircraft are interrogating in the same proximity, transponder replies may overlap in time (e.g., become garbled). Consequently, air traffic control (ATC) systems may have difficulty tracking individual aircraft. To overcome this problem TCAS was designed with logic that, when a certain number of TCAS equipped aircraft are within a predetermined vicinity of each other, TCAS on each aircraft would operate in an interference limiting mode having reduced output power, reduced number of interrogations, reduced receiver sensitivity, and consequently a reduced intruder tracking range. In low traffic density regions increased transmission power is suitable whereas in high traffic density regions (conventionally called Terminal Control Areas (TCAs)) reduced transmission power is desirable. For example, the TCAS of an aircraft flying over Western Kansas may have an interrogation range of 80 nm (nautical miles) or longer; whereas, an aircraft flying near Chicago may reduce its interrogation range to 5 nm with greater link margin. The reduction of transmission power from a low density region to a high density region may be as much as 10 dB. Transmission power is reduced to reduce RF interference between TCAS equipped aircraft and to reduce RF interference with ATC ground tracking stations.

If TCAS equipped aircraft, such as military aircraft, were to fly in a multi-aircraft group known as a formation, and each TCAS was actively interrogating, each airborne TCAS of an aircraft included in the formation and those nearby but not in the formation may react to the seemingly high density of traffic and begin operating in the interference limiting mode. Each may also reduce receiver sensitivity to compensate for the perceived density. The resulting reduction in intruder tracking range would increase the risk of collision to unacceptable levels (e.g., particularly with aircraft flying at relatively high speed). TCAS equipped aircraft may begin operating in interference limiting mode even in formations of two or three aircraft.

Honeywell (formerly Allied Signal) developed a collision avoidance system designed to specifically address military formation-flying insufficiencies of conventional TCAS; this system is known as Enhanced TCAS (ETCAS). ETCAS provided means for military planes to fly in formation by offering a rendezvous-type feature in collision avoidance systems that would allow aircraft to be able to fly in a formation with other aircraft without generating RAs and TAs against one another. However, ETCAS also generated significant interference limiting behavior in non-formation aircraft. The FAA and civilian regulatory agencies of other countries severely restricted the use of TCAS, including ETCAS, during formation flying due to the consequences of inappropriate operation in an interference limiting mode. These restrictions essentially require several members in a formation to fly with their TCAS turned off, while one or a few aircraft in the formation are allowed to fly with TCAS turned on. These restrictions obstruct the purpose of collision avoidance systems since many members of a formation have no indication of potential collision threats between themselves and non-formation aircraft as well as potential collisions threats between other members of the formation. Further, the restrictions on the use of TCAS during formation flying detract from the advantages of using ETCAS.

The block diagram of FIG. 2 illustrates an example of interference limiting. As shown, a group of aircraft 210–215 are flying in formation 200 while TCAS equipped aircraft 220 is approaching formation 200. The wavy lines in front of an aircraft symbol in FIGS. 1–3 indicate transmission from the TCAS aboard that aircraft.

When the TCAS of aircraft 220 receives TCAS broadcasts (interrogations) from aircraft 210–214 within range (e.g., within surveillance region 260), the TCAS of aircraft 220 forms intruder tracks and perceives a high density of intruders 210–214. The TCAS of aircraft 220 may consequently begin operating in a mode with reduced surveillance range (e.g., an interference limiting mode), for example, with a surveillance region 261 that is smaller than a typical surveillance region. The reduction in the number and transmission power of TCAS broadcasts is gradual and may not be recognized by a pilot or flight crew. Reducing the size of a surveillance region may be dangerous for aircraft flying at high speeds, as warning time and time to act on a resolution advisory may be significantly reduced.

Presently, under the requirements of the FAA and various other airworthiness authorities in several countries, only one or a few aircraft in a formation is allowed to have an actively interrogating TCAS (referred to herein as active TCAS). If all the members in a formation are not interrogating, significant safety problems can arise. That is, the non-interrogating formation members will not be aware of potential collision threats between themselves and non-formation aircraft because their respective TCAS is turned off. The non-interrogating members of the formation will also have no warning by their respective TCAS of potential collisions with other formation members.

Further, conventional symbols used in presentations of air traffic do not distinguish formation members from non-formation traffic and do not provide indicia of whether or not tracking is based on replies to interrogation. Without symbols of the present invention, unsafe conditions may arise during formation flight including conditions arising from delayed or unnoticed changes in tracking of formation members and non-formation traffic.

SUMMARY OF THE INVENTION

The present invention substantially eliminates one or more of the problems associated with the prior art by presenting surveillance and collision avoidance information that distinguish formation members from non-formation traffic and/or distinguish differences in methods for monitoring traffic. Distinctions are made using a set of compound symbols. By presenting symbols for formation members that are different from symbols for non-formation traffic, flight crew can more easily maintain situational awareness, thus increasing flight safety. By presenting symbols for traffic according to replies to interrogations directed to such traffic different from symbols for traffic according to messages received without interrogation, differences in the reliability of the presentation are made evident. Generally, replies to interrogations provide more up to date and more accurate situational awareness to the flight crew than information based on messages received without interrogation. Greater flight safety results from assisting the flight crew to easily maintain up to date and accurate situational awareness.

BRIEF DESCRIPTION OF THE DRAWING

Additional aspects and advantages of the present invention will become apparent from the description of the invention with reference to the drawing, wherein like designations denote like elements and in which:

FIGS. 9 and 10 each provide a table of symbols used for presentations according to various aspects of the present invention.

DETAILED DESCRIPTION OF THE PREFERRED EMBODIMENTS

A surveillance and collision avoidance (SCA) system or air traffic management system, according to various aspects of the present invention, has subsystems that operate selectively in a passive mode or in an active mode. By operating in a passive mode, the subsystem is not transmitting interrogations of the type described above as TCAS interrogation signals (e.g., received by ATCRBS and MODE S transponders) yet performs tracking and provides collision avoidance advisories (e.g., TAs or RAs) in accordance with unsolicited received signals (e.g., squitters) and information received from a formation member via a network. Typically, the host aircraft and other aircraft when flying in a formation are members of such a network. SCA subsystems operating in a passive mode may transmit or receive signals in various protocols compatible with SKE (Station Keeping Equipment), ADS-B (Automatic Dependent Surveillance-Broadcast), TIS-B (Traffic Information Service Broadcast), and/or squitter signals. An SCA subsystem operating in an active mode transmits interrogations of the type described as TCAS interrogation signals to solicit replies from the transponders of nearby traffic. Formation members having systems operating in an active mode communicate surveillance information to formation members having systems in a passive mode to provide information pertaining to current air/ground traffic.

In a preferred embodiment of the invention, a wireless communication network is established among members in a formation. Any conventional network technology may be used to implement such a network. In one implementation, ADS-B extended squitter transmissions are used to establish the network and communicate among members of the network. In other implementations, signaling in other protocols may be used including SKE compatible protocols. The wireless communication network enables formation members having subsystems operating in an active mode and formation members having subsystems operating in a passive mode to share data relating to current air/ground traffic and potential collision threats.

Figure 3A:
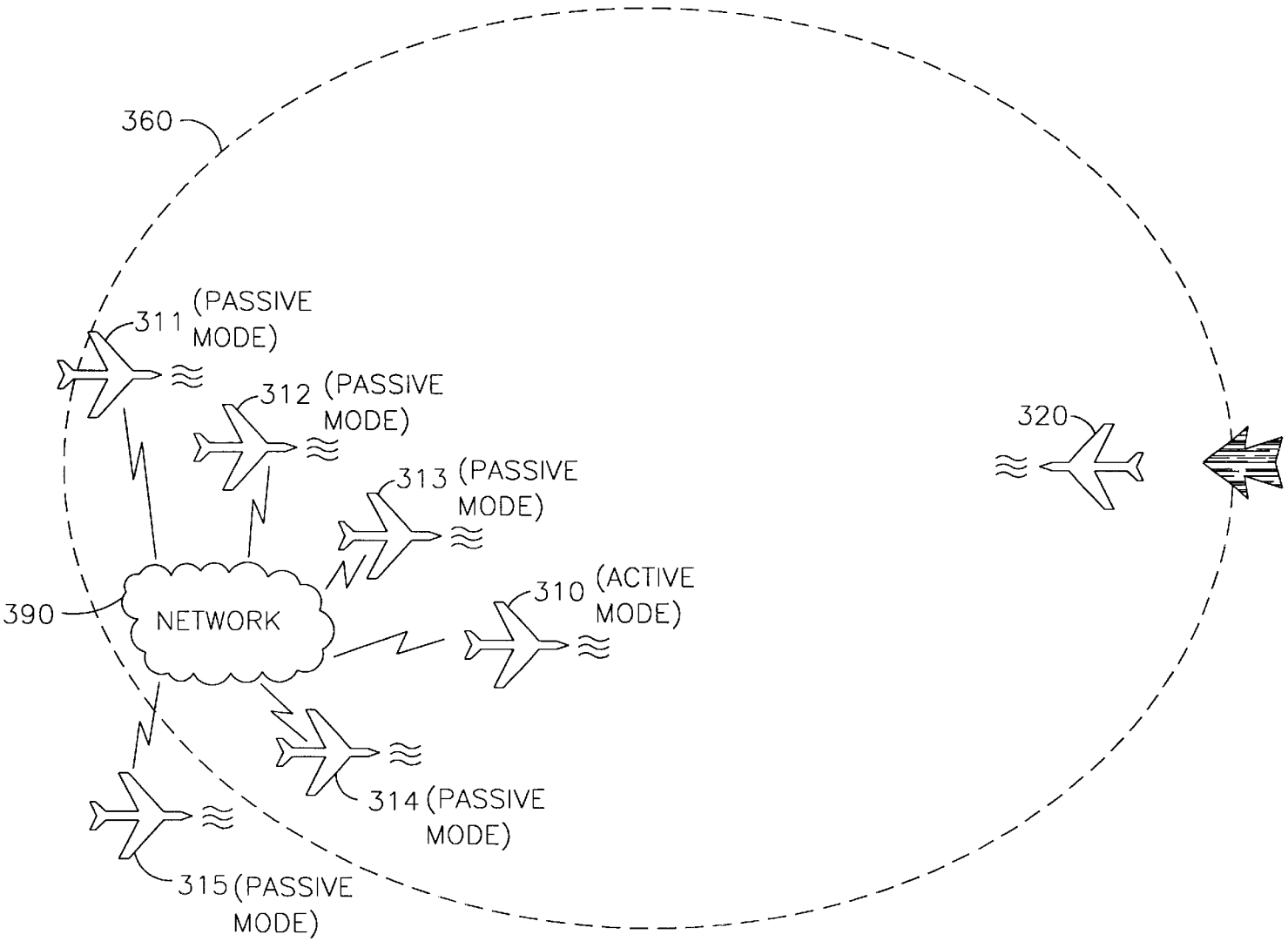
FIG. 3A is a top view of another scenario with aircraft flying in a formation using a surveillance and collision avoidance system and method according to various aspects of the present invention.
Figure 3B:
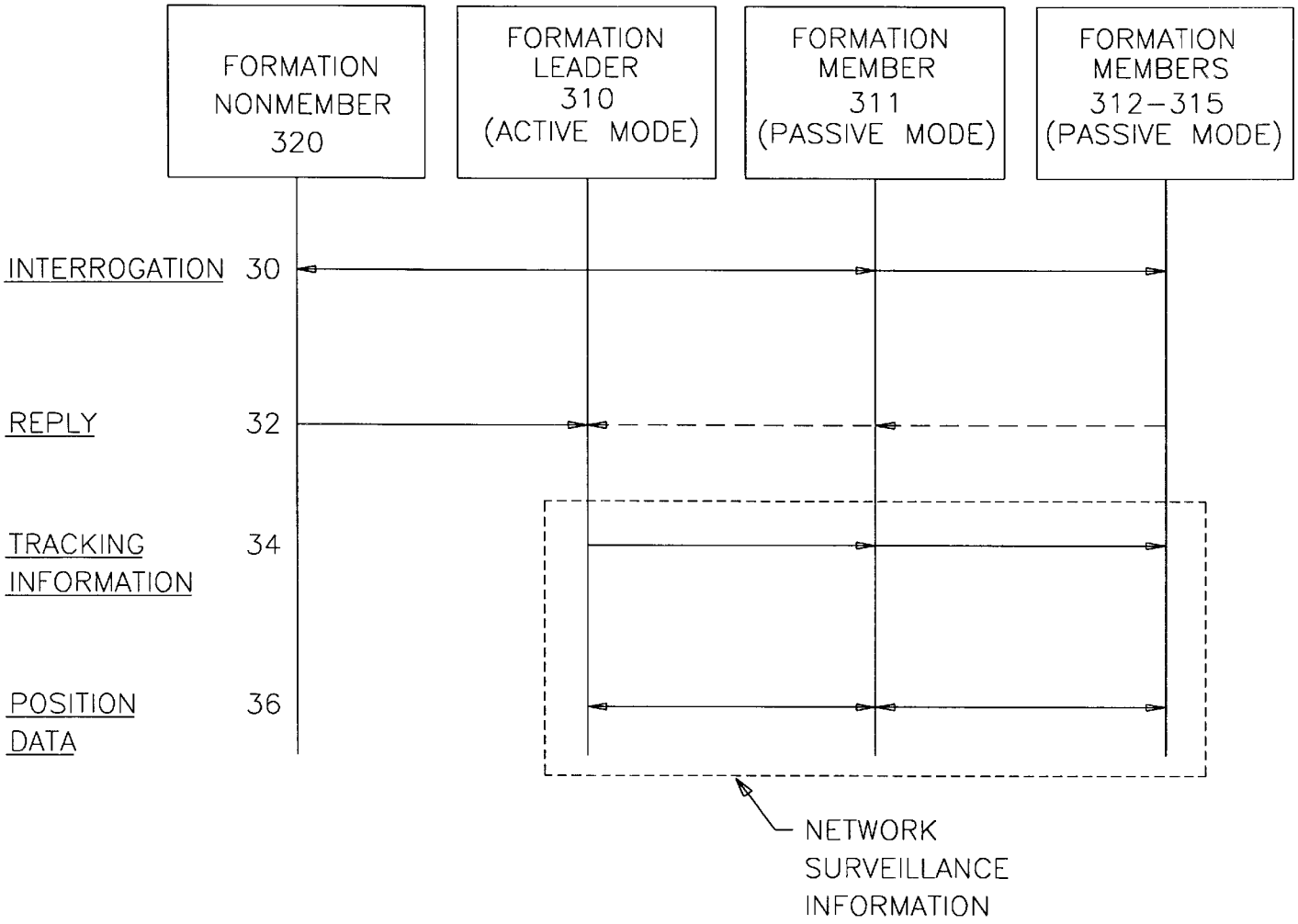
FIG. 3B is a message sequence diagram of communication between aircraft of FIG. 3A.

In the example scenarios of FIGS. 3A and 3B, formation leader 310 is the only member of formation 300 transmitting interrogations (indicated as wavy lines in FIG. 3A). In other words, formation leader 310 hosts a subsystem operating in an active mode. All other members 311–315 of formation 300 host subsystems operating in a passive mode. The number of formation members hosting subsystems operating in an active mode is a function of the overall size of the formation, the number of aircraft in the formation, and restrictions imposed by the FAA and other authorities.

When formation leader 310 is transmitting interrogations 30 (FIG. 3B) (interrogating), leader 310 will receive a reply 32 from formation nonmember 320 in response to the interrogation, assuming nonmember 320 has some type of enabled transponder. Leader 310 may also receive replies from nearby formation members 311–315 if these formation members have their transponders enabled for transmitting replies. The reply from nonmember 320 includes the position and other relevant information for the pilot of leader 310's situational awareness of nonmember 320. Additional information may be obtained from nearby aircraft without need for interrogations (e.g., receiving squitter and ADS-B signals).

The information of the reply 32 varies with the type of equipment and settings of the transponder hosted by nonmember 320. Alternative types of transponders hosted in each aircraft may include Mode-A, Mode-C (often used for aircraft only utilizing Air Traffic Control Radar Beacon Systems or ATCRBS), and Mode-S transponders. A Mode S transponder squitter contains Mode S aircraft identification and may contain air/ground status.

Information on nearby air traffic may also be provided or obtained using a transponder or transceiver compatible with ADS-B signals. The transmission is similar to that of the current Mode S transponder squitter, but conveys more information (e.g., altitude). Equipment for ADS-B transmissions typically include a receiver for signals from a satellite-based global positioning system (GPS) to determine an aircraft's location in space. Such equipment automatically and periodically transmits an ADS-B signal that includes, with respect to the host aircraft, flight information; position information; velocity; altitude; whether the aircraft is climbing, descending, or turning; type of aircraft; and flight ID. The flight ID is a numeric and/or alphanumeric identifier uniquely assigned to identify each aircraft. Other aircraft and ground stations within roughly one hundred and fifty miles of the host aircraft receive these broadcasts and typically display received and derived information on a screen (e.g., a Cockpit Display of Traffic Information (CDTI)).

Information relating to nearby air/ground traffic is collectively referred to herein as tracking information 34. Tracking information 34 may include, for each nearby aircraft or ground vehicle: the latitude, longitude, altitude, air speed, identification, ground speed, and intent information.

When the host aircraft is prepared to fly in a formation, identification of all members of this formation are stored for access by an SCA subsystem. The SCA subsystem may determine that a target is a member of this formation by obtaining a flight ID or Mode S address of the target; and determining that the flight ID or Mode S address is associated with the formation (e.g., a list of stored flight IDs includes the flight ID of the target).

The SCA subsystem of leader 310 may use tracking information 34: to calculate, if necessary, the range, relative altitude, and relative bearing of nonmember 320; to determine a time to closure; and to determine whether a potential collision threat exists with reference to host aircraft 310 navigation information. The SCA subsystem of leader 310 may also track aircraft 320 and provide a presentation for a traffic display even when a potential collision threat does not exist.

Tracking information 34 about nonmember 320 is communicated from leader 310 to other formation members 311–315 via wireless network 390. Position data 36 relating to leader 310 may also be communicated to other members of formation 300 via wireless network 390. Those formation members that have their SCA subsystems operating in a passive mode (e.g., 311–315) may use the information received from the network 390 to provide a presentation that facilitates pilot situational awareness of nearby traffic as well as situational awareness of other formation members. The presentation may be displayed on any suitable display. Formation members may also use information received from network 390 to determine potential collision threats with other aircraft. Each formation member 310–315 preferably exchanges position data and identification information of each formation member and tracks other formation members. Signaling compatible with ADS-B, TIS-B, Mode S squitter, and SKE subsystems, in any combination, may be used to determine potential collision threats against members and nonmembers depending upon the equipment in each formation aircraft. The information communicated between formation members is collectively referred to herein as network surveillance information.

Figure 1A:
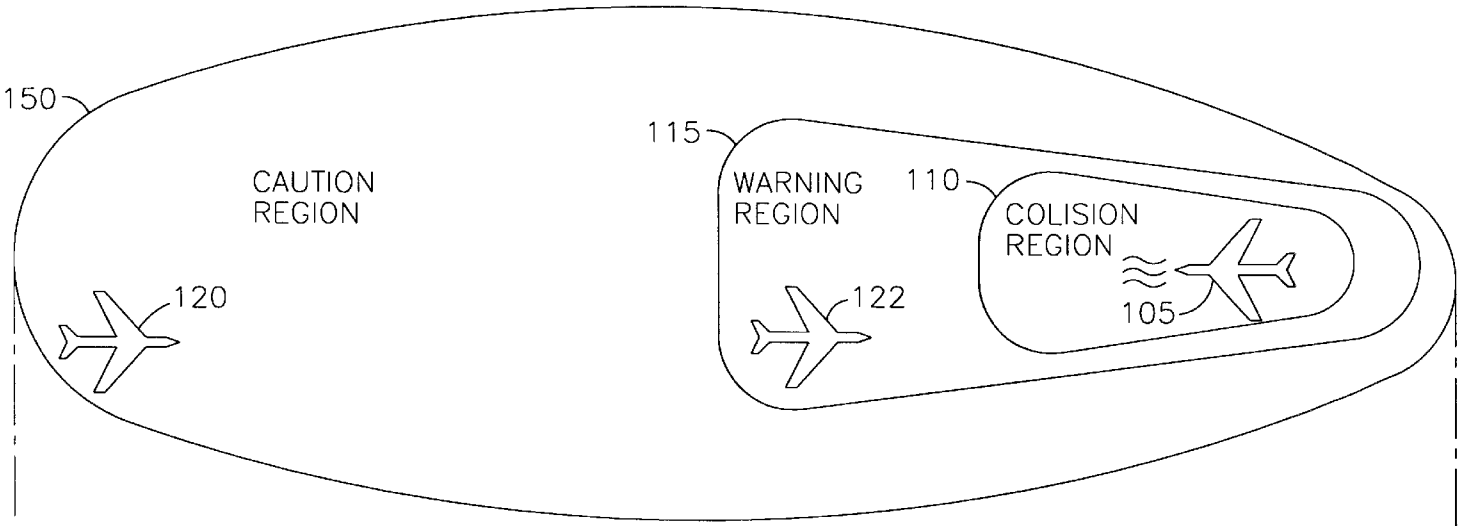
FIG. 1A RELATED ART
FIGS. 1A and 1B are top and perspective views respectively of a scenario with caution, warning, and collision regions of a conventional TCAS.
Figure 1B:
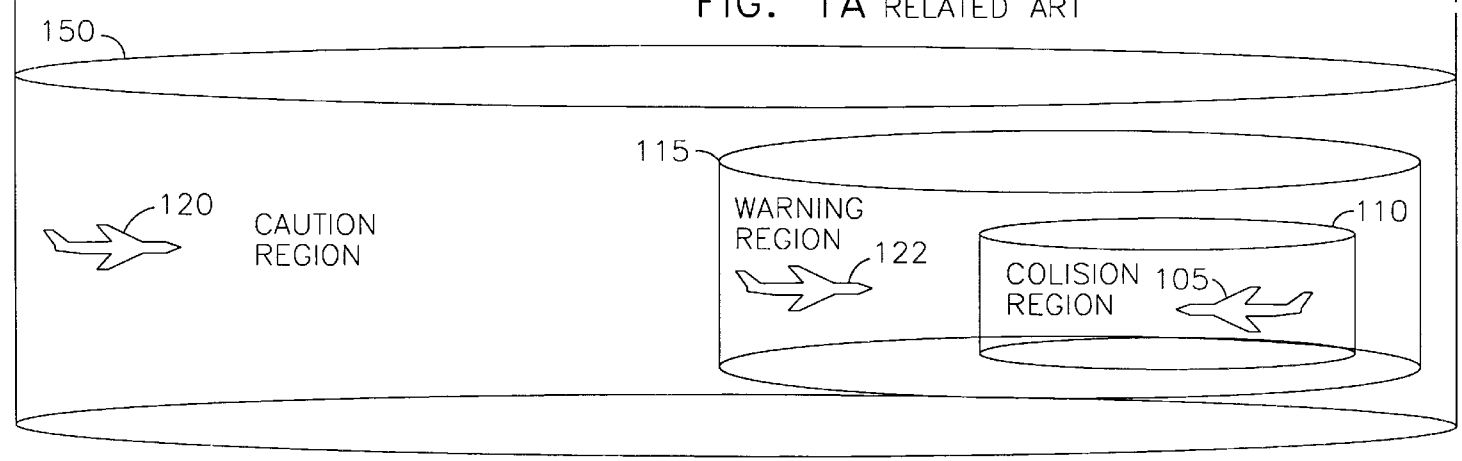
FIG. 1B RELATED ART
Figure 2:
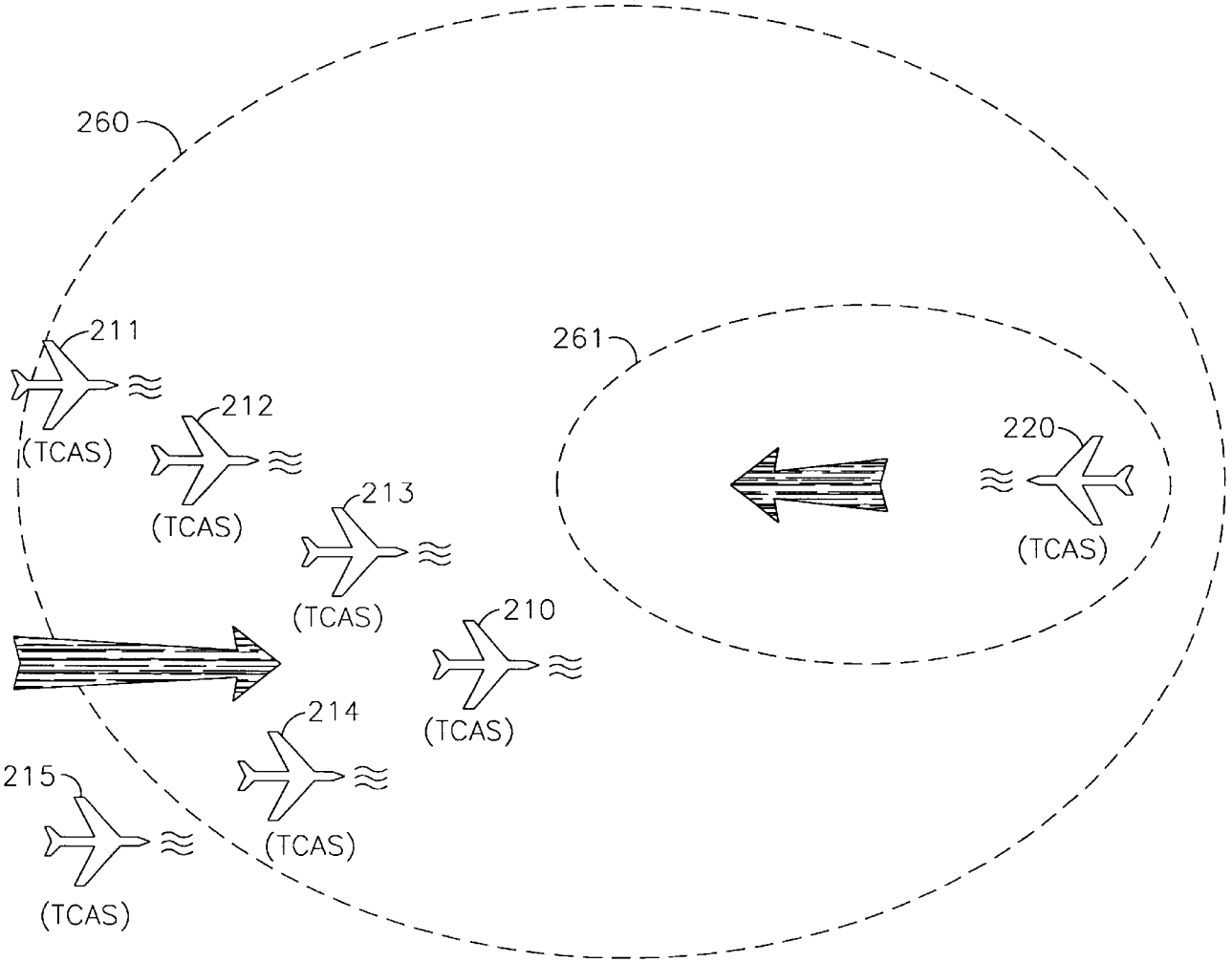
FIG. 2 RELATED ART
FIG. 2 is a top view of another scenario with a conventional TCAS in each aircraft flying in a formation.

The members of formation 300 may track each other, as well as track nearby traffic, using network surveillance information. Network surveillance information may be used by formation members for determining whether a potential collision threat exists between themselves and leader 320, for determining whether a potential collision threat exists between themselves and other formation members, for tracking members and nonmembers, and/or for preparing presentations of tracking information for display on respective displays of formation members. A potential collision threat may exist if nonmember 320 penetrates the perimeter of the caution region of any of formation members 310–315 (e.g., perimeter 150 illustrated in FIG. 1). Generally, the surveillance range of an SCA subsystem (in either an active mode or a passive mode) exceeds a caution region, for example as shown in FIG. 1.

Passive tracking and the determination of potential collision threats by formation members each having an SCA operating in a passive mode may involve (a) receiving network surveillance information, (b) determining a position of the formation member relative to an aircraft (e.g., leader 310) that has an SCA subsystem operating in an active mode, (c) performing collision avoidance calculations using the determined relative position and the received network surveillance information, and (d) using the results of calculations to provide cautions (e.g., TAs and/or RAs) and warning data.

In an alternate implementation, a formation member having an SCA subsystem operating in a passive mode uses the network surveillance information to prepare a presentation of air traffic and display the presentation without performing any collision avoidance calculations.

If a potential collision threat to a host aircraft is determined by an SCA subsystem operating in a passive mode, at least three options are available: (1) the SCA subsystem may cease operating in a passive mode and begin operating in an active mode (e.g., automatically wake up); (2) the pilot or crew of the host aircraft may be alerted that a potential collision threat exists and the pilot or crew may manually direct the SCA subsystem to cease operating in a passive mode and begin operating in an active mode; or (3) the SCA subsystem may continue operating in a passive mode but provide traffic advisories to the flight crew based on updated network surveillance information (e.g., regarding aircraft 320). Resolution advisories may also be provided by the SCA subsystem operating in a passive mode. In one implementation, coordination of RAs between an intruder's TCAS and an SCA system having subsystems operating in a passive mode is accomplished when at least one SCA subsystem begins operation in an active mode. Any combination of the foregoing options may be implemented as well.

Figure 4:
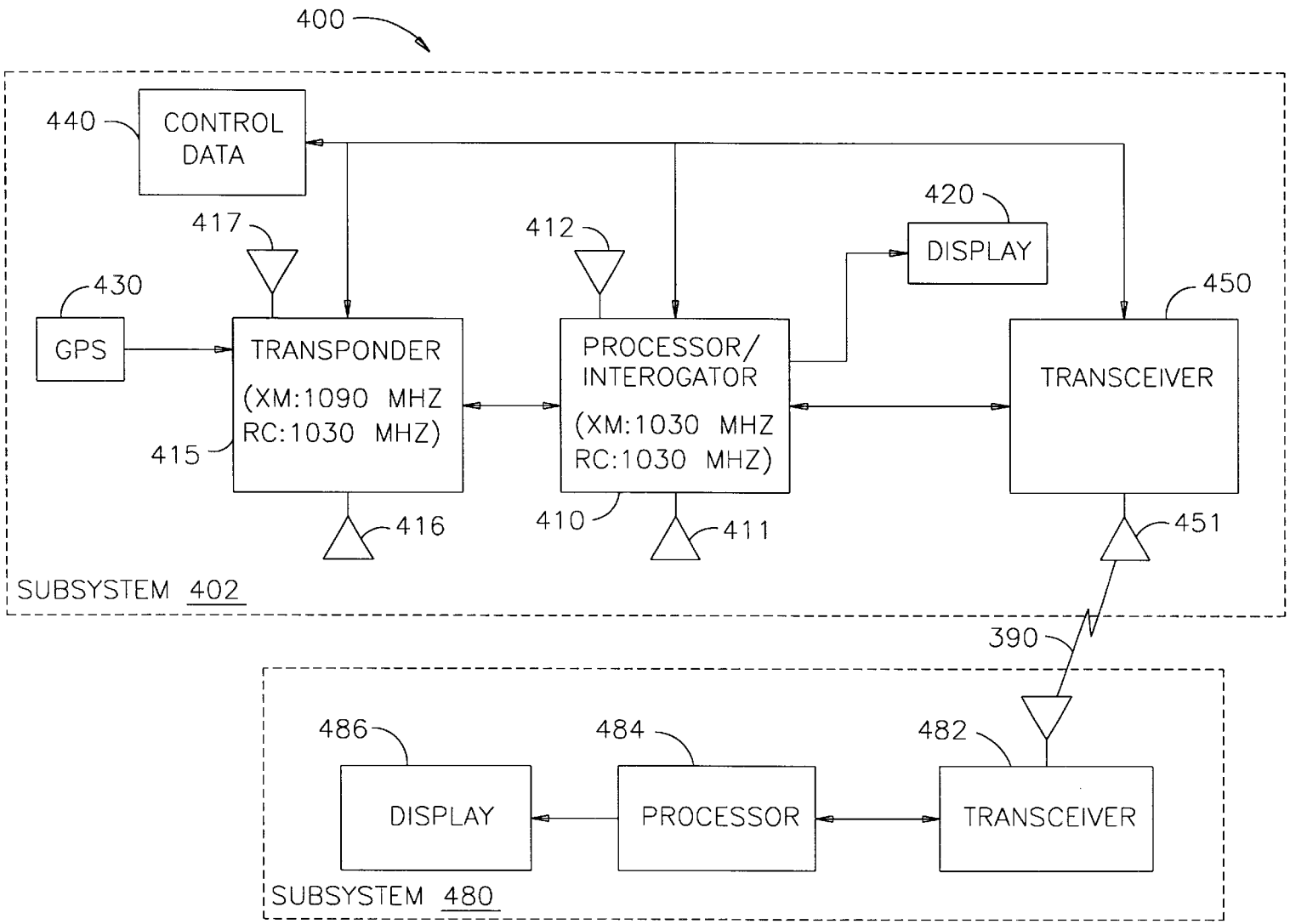
FIG. 4 is a block diagram of a portion of a surveillance and collision avoidance system according to various aspects of the present invention.

According to various aspects of the present invention, select aircraft flying in a formation may operate an onboard SCA subsystem in an active mode while other members of the formation operate respective onboard SCA subsystems in a passive mode. Communication between SCA subsystems in aircraft flying in a formation includes communication between two or more subsystems. For example, SCA system 400 of FIG. 4 includes an SCA subsystem 402 operating in an active mode and an SCA subsystem 480 operating in a passive mode. SCA system 400 communicates network surveillance information between formation members having an SCA in an active mode and formation members having an SCA subsystem operating in a passive mode to: (a) reduce the risk of collision between a formation member and a nonmember; and/or (b) reduce the risk of collision between formation members.

An SCA subsystem is provided on each aircraft that may fly in a formation. In one implementation, each SCA subsystem includes a TCAS, modified to perform the functions discussed herein. Subsystem 402 is implemented on an aircraft that may interrogate nearby air traffic and generally includes: a collision avoidance processor and interrogator 410 for interrogating via antennas 411 and 412, receiving replies via antennas 411 and 413, processing replies to its interrogations, generating information to be displayed to a pilot, and executing collision avoidance algorithms; a transponder 415 for receiving interrogations and transmitting replies; a global positioning system (GPS) receiver 430 for obtaining current navigational information; a transceiver 450 for establishing a communication link to receive/transmit network surveillance information; a control unit 440 for selecting functionality of the respective components; and a display 420 for displaying a presentation of nearby traffic and/or displaying indicia of TAs and/or RAs to the pilot or crew. Any group of the foregoing components may be combined and implemented as a packaged component (e.g., a circuit card assembly or line replaceable unit (LRU)).

Transponder 415 is configured to communicate with the processor/interrogator 410 so that: (a) interrogations are transmitted via antennas 416 and 417 for reception by nearby air traffic; and (b) replies to the transmitted interrogations may be received via antennas 416 and 417 and passed to processor/interrogator 410.

Information received in reply to interrogations is suitably communicated as network surveillance information to other members in the formation through data transceiver 450 and its respective antenna 451. Information received in reply to an interrogation is processed by processor/interrogator 410. Processing by processor 410 includes comparing host aircraft current position information (e.g., provided by GPS receiver 430 and other on-board instruments) and other aircraft position information to determine potential collision threats using any conventional algorithm. Traffic display 420 is updated by processor/interrogator 410 to display nearby air traffic including formation and non-formation aircraft and/or provide TAs and RAs to the pilot.

Processor/interrogator 410 may include any device or combination of devices capable of performing the functions described herein. In a preferred embodiment of the invention, processor/interrogator 410 includes a modified or augmented TCAS 2000 computer unit available from Aviation Communication & Surveillance Systems (ACSS), an L-3 Communication & Thales Company, which incorporates FAA Change 7 software. A TCAS 2000 system includes an RT 950/951 receiver/transmitter (R/T) unit, top directional antenna 412, and bottom directional or omni directional antennas 411. The R/T unit performs airspace surveillance, performs intruder tracking, generates a traffic presentation for display, computes a threat assessment, provides collision threat resolution, and provides coordination between the host aircraft and nearby TCAS-equipped aircraft for non-conflicting RAs. The R/T unit computes the bearing of an intruder from antennas 411 and 412, which are preferably AT 910 Top-Directional/Bottom-Omni Directional antennas, and determines the range between the host aircraft and the replying aircraft by measuring lapse of time between transmitting an interrogation and receiving a reply.

In the preferred embodiment processor/interrogator 410 broadcasts on a frequency of 1030 MHz and receives replies on a frequency of 1090 MHz. In an active mode, the R/T unit provides network surveillance information to transceiver 450 for communicating to members of the formation each having an SCA subsystem operating in a passive mode. When operating in a passive mode, the R/T unit provides processing means for tracking nearby traffic and/or threat assessment based on received network surveillance information. Tracking and threat assessments by the R/T unit operating in a passive mode may also be based on ADS-B or other squitter information received independently of communication link 390.

Transponder 415 includes any device or combination of devices capable of receiving an interrogation from another aircraft or from an ATC ground station and capable of transmitting a reply to the interrogation. As previously discussed, replies to interrogations may include the latitude and longitude of the host aircraft current position as well as other information including host aircraft identification (e.g., 24 bit Mode-S address). In a preferred embodiment, transponder 415 is an XS-950 or XS-950S/I Military Mode-S/IFF transponder having ground-based and airborne interrogation capabilities. Transponder 415 preferably includes ADS-B functionality. Transponder 415 is coupled to top and bottom ATC omnidirectional antennas 416 and 417 for transmitting/receiving information to/from other aircraft or ground-based ATC systems. In the preferred embodiment, transponder 415 transmits on a frequency of 1090 MHz and receives on a frequency of 1030 MHz.

GPS receiver 430 may include any device or devices that provide current navigational data to subsystem 402. GPS receiver 430 is coupled to transponder 415 to provide latitude and longitude coordinates of the aircraft for broadcast and/or to calculate potential collision threats. For example, GPS position information may be used when operating in a passive mode to determine the host aircraft position relative to the position of a formation leader 310. The formation leader's position information is received by transceiver 450 as network surveillance information. The formation leader has an SCA subsystem operating in an active mode.

Transceiver 450 facilitates communication of network surveillance information from and to other aircraft in a formation. Transceiver 450 is preferably an RF transceiver operating on a frequency other than that of the interrogation and reply channels used by transponder 415 and processor/interrogator 410. Transceiver 450 may be any type of wireless communication system operating on any frequency range. Transceiver 450 is coupled to processor/interrogator 410 to provide network surveillance information received from other formation members to processor 410 and to transmit network surveillance information when SCA subsystem 402 is operating in an active mode. Transceiver 450 establishes network link 390 between the host aircraft and other formation members and transmits/receives data over network link 390 utilizing spread spectrum modulation. Transceiver 450 includes antenna 451 to transmit and/or receive network surveillance information.

Antenna 451 is preferably an omni-directional or segmented directional antenna for communication on a non-ATC frequency (e.g., other than 1030 MHz and 1090 MHz).

Preferably, transceiver 450 is implemented using equipment that serves other purposes on the host aircraft. For example, military aircraft configured to fly in formations often have Station Keeping Equipment (SKE) used for keeping planes in formation position. The SKE used in this type of military aircraft, for example the C-130, communicate position, range, and control information between formation members for functions such as autopilot. SKE transmitter/receivers typically operate on frequencies between 3.1 to 3.6 GHz and include useable data transfer rates of 40 Kbps.

Existing SKE is integrated with an SCA subsystem to communicate network surveillance information over the existing SKE communication links between formation members (e.g., network link 390). When using SKE-equipped aircraft, the present invention may be implemented by providing a software update for processor/interrogator 410; providing physical connectivity between the SKE and processor/interrogator 410; and providing physical connectivity between the SKE and control unit 440. In the event an aircraft does not have SKE, network link 390 may be implemented using a dedicated transceiver 450 or using ADS-B communications at 1090 MHz from the formation leader to convey network surveillance information. In a preferred embodiment, SKE is connected to processor 410 using two dual wire serial buses each providing serial communication between processor 410 and the SKE.

Transceiver 450 is connected to processor 410 using any suitable communication bus. The buses connecting the SKE to processor 410, as well as most data connections in subsystem 402 are preferably ARINC 429 data buses.

Control unit 440 provides information to transponder 415 prescribing display data such as altitude and speed; controls function selection for transponder 415 (e.g., transmission mode and reporting functions); controls function selection for processor/interrogator 410 (e.g., entry/exit of a passive mode, or an active mode); controls function selection for transceiver 450; and controls function selection for display 420. Control unit 440 also may include a processor for processing information outside of processor 410. In a preferred embodiment, control unit 440 includes an ATC transponder and TCAS control unit implemented as an integrated menu-driven, multi-function, cockpit display unit (MCDU). An L-3 control panel or Gables control panel may also serve as control unit 440. Control unit 440 preferably controls other system components over an ARINC 1553 data bus.

Display 420 includes one or more display units compatible with ARINC 735 display bus protocols for displaying host aircraft position, displaying positions of nearby traffic (e.g., formation members), and/or displaying TAs and RAs generated by processor/interrogator 410. Processor 410 provides surveillance and collision avoidance information to display 420 in one or more presentations. Display 420 is suitably located in the cockpit of the host aircraft. The surveillance and collision avoidance information provided to display 420 suitably includes any of the aforementioned information relating to tracking nearby traffic, advisories, as well as information relating to tracking formation members. In addition, display 420 preferably presents SKE display information and information for identifying and tracking other formation members. In one implementation display 420 comprises two display screens: a traffic display and an RA display. In another implementation, display 420 comprises one display screen for presenting both traffic and RA presentations when RAs are provided by processor 410. SKE equipped aircraft typically have a separate display for presenting positions of formation members.

Figure 8:
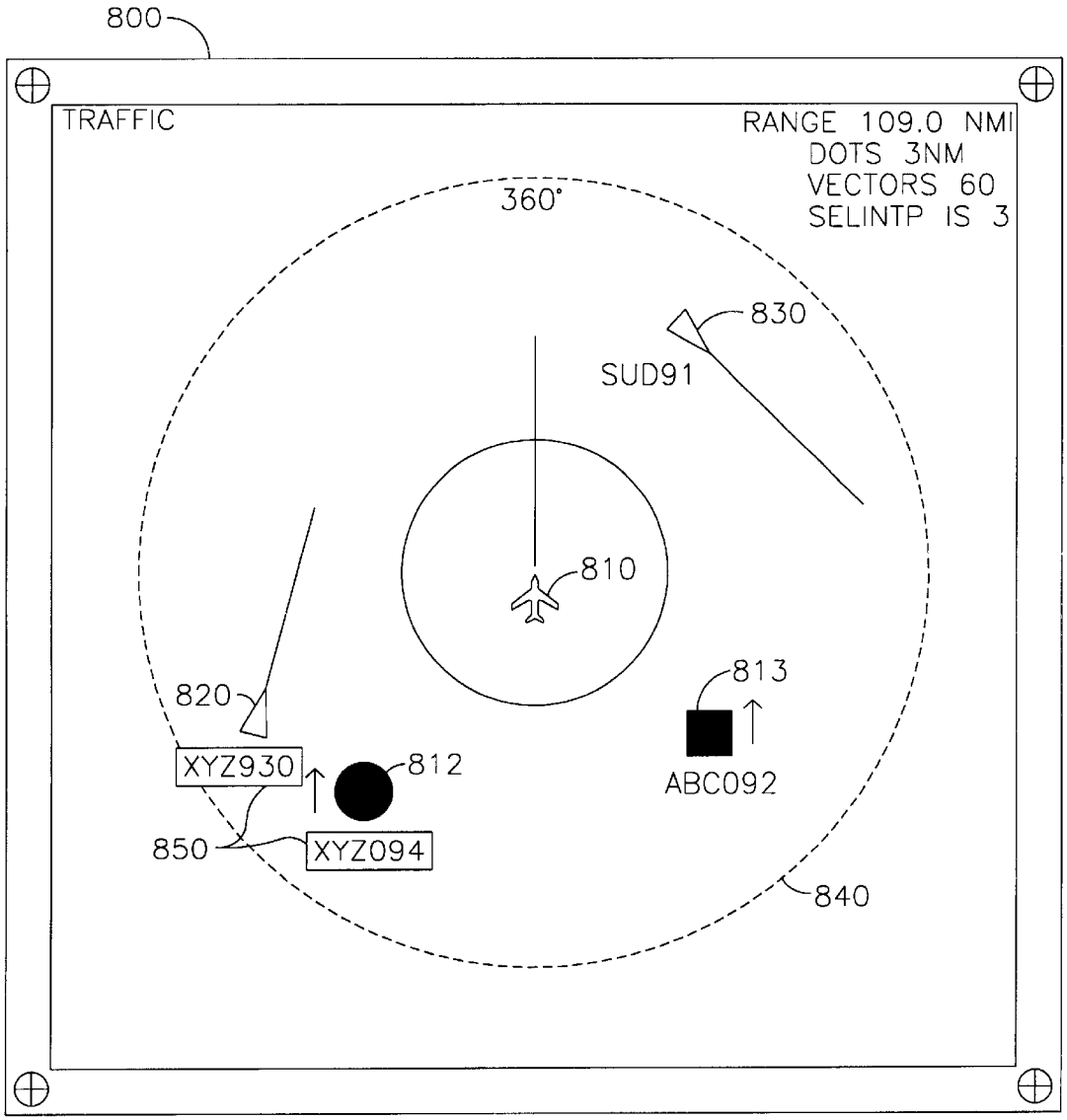
FIG. 8 is a plan view of a presentation of symbols according to various aspects of the present invention.

In a preferred embodiment of the invention a single display screen presents SKE information and SCA information. By coordinating and integrating available SCA, ADS-B, and SKE information in processor 410, one or more presentations may be generated for describing both formation members and nonmembers to a pilot in a uniform format on a single display device (whether or not the host SCA is operating in an active mode or in a passive mode). Integrated presentations are described below, for example, with reference to FIGS. 8–10.

Display 420, depending on the aircraft type and cockpit configuration, may present a variety of information including a radar presentation, a shared weather radar presentation, a map and/or navigation presentation, a SKE presentation, a multifunction presentation, an Electronic Flight Instrument System (EFIS) presentation, an Engine Indication and Crew Alerting System (EICAS) presentation, as well as any combination of the foregoing. Display 420 may be implemented using a flat panel integrated display.

Subsystem 480 communicates with subsystem 402 via network link 390. Subsystem 480 represents a SCA subsystem installed in a formation member aircraft. Subsystem 480 receives network surveillance information from any SCA subsystem operating in an active mode, for example, subsystem 402, as discussed above. Subsystem 480 may be identical to subsystem 402 or have fewer components if subsystem 480 will not be transmitting interrogations. Subsystem 480 includes at least: a receiver or transceiver 482 for receiving network surveillance information over network link 390 from other formation members; a processor 484 for processing information received by transceiver 482; and a display 486 for displaying nearby traffic and/or providing warnings including TAs and RAs generated by processor 484 based on the network surveillance information.

While not shown, subsystem 480 may also include a transponder for replying to interrogations from other aircraft and a GPS receiver for obtaining current navigational information. Navigational information may be provided in response to interrogations. Navigational information may also be used to determine host aircraft position relative to formation members that are interrogating. The host's relative position is compared with received network surveillance information at processor 484 to determine potential collision threats and to track other aircraft. The components in subsystem 480 may be the same type of equipment as previously described with reference to subsystem 402. For example, transceiver 482 may include a transceiver of the type discussed above with reference to transceiver 450 or include a SKE receiver/transmitter unit. Processor 484 may include a processor of the type discussed above with reference to processor 410 operating in a passive mode. Display 486 may include a display of the type discussed above with reference to display 420.

While specific components have been described above with reference to preferred embodiments, the skilled artisan will recognize the present invention could be implemented in any number of hardware and software configurations depending on the equipment available and the functionality desired. Consequently, the systems of the present invention are not limited to any specific configuration discussed in reference to the preferred embodiments.

Surveillance and Collision Avoidance of Formation Nonmembers

An SCA system, according to various aspects of the present invention performs a method for avoiding collisions between formation nonmembers and formation members. For example, system 400 performs a method 500 of FIG. 5 for avoiding collisions between formation nonmembers and formation members wherein one or more of the formation members have SCA subsystems operating in a passive mode. When multiple aircraft are flying in a formation, at least one formation member includes an SCA subsystem 402 operating in an active mode for interrogating nearby aircraft, while the remaining members of the formation include an SCA subsystem 480 operating in a passive mode. The determination and control of which formation members will operate in an active mode and which formation members will operate in a passive mode may be automatically configured, taking into consideration position of the formation members in the formation, a distance between formation members, and other dynamic factors. The determination may further be based on which members are, or will be, flying in a formation leader role or position and on the type of equipment available in each aircraft.

The formation member or members that are interrogating obtain information (515) about nearby nonmember traffic through interrogate-reply protocols. When an interrogating formation member obtains any new or updated information about nearby nonmember traffic (e.g., replies or broadcasts from nearby traffic), that member communicates (520) network surveillance information to the formation members that have SCA subsystems operating in a passive mode. Communication is via a link (e.g., communication link 390).

Each formation member preferably has an onboard global positioning system (GPS) receiver that provides latitude and longitude coordinates of the host aircraft. The coordinates of the interrogating formation member(s) may be provided (523) as part of the network surveillance information so that formation members having SCA subsystems operating in a passive mode may determine (525) their position relative to that of the interrogating formation member(s). In SKE-equipped aircraft, each aircraft in a formation may continually track its position, speed, altitude, and bearing relative to the other members of the formation.

Position and identification information about formation members may also be exchanged (520, 523) via ADS-B messages among formation members equipped to send and receive ADS-B messages. Each formation member having an SCA subsystem operating in a passive mode may determine its own relative position, speed, altitude, and vertical speed and may compare this information with the network surveillance information about non-formation aircraft provided by the formation member(s) having an SCA subsystem operating in an active mode. By this comparison, a formation member having its SCA subsystem operating in a passive mode can determine (530) whether a potential collision threat exists with a nonmember. In this embodiment, a threat may exist when conventional collision avoidance algorithms in the SCA subsystem determine that a collision or near collision may occur between the formation member having an SCA subsystem operating in a passive mode and a nonmember.

If (535) a threat exists, the pilot is made aware (540) of the threat. An SCA subsystem operating in a passive mode may provide TAs, RAs, and/or other warning information to enable pilot awareness and/or resolution of the threat. In a first implementation, RAs generated by an SCA subsystem operating in a passive mode are not coordinated with the RAs of formation nonmembers. In a second implementation RAs generated by an SCA subsystem operating in a passive mode but in a threat situation are transmitted and coordinated with RAs of nonmembers. In a third implementation, when RAs are provided, the SCA subsystem operating in a passive mode is either automatically or manually switched to operation in an active mode, for coordination of RAs.

A presentation is generated or updated (545) to reflect the nearby nonmember traffic based on the network surveillance information (523) and the host's relative position (525). A display of the presentation is provided (550) to the pilot or another member of the flight crew. The process may continue in a loop to again proceed (515 or 523) depending on current operating mode (510) as discussed above.

An SCA subsystem operating in an active mode may interrogate at selected power levels. For example, the method of FIG. 6 is an implementation of a method to perform surveillance (515) as discussed above with reference to FIG. 5. If the SCA subsystem is not hosted (602) by a formation member (e.g., normal flight), TCAS II transmitting power levels are used (610). TCAS I power levels are used (620) in a situation where all of the following conditions are met: the SCA subsystem is hosted by a formation member (604) (i.e., not a leader), traffic density is relatively high (606) (e.g., as indicated by the number and quality of received signals by transponder 415, or receiver/transmitter functions of processor 410), and no resolution advisory is pending (608). In all other cases TCAS II power levels are used.

Controls on control unit 440 or on processor 410 are set for a formation leader or set for normal operation (e.g., not flying in a formation). A formation leader's SCA subsystem operates in an active mode to provide network surveillance information to formation members having SCA subsystems operating in a passive mode. By actively interrogating nonmember traffic, the formation leader obtains surveillance information that the formation members do not obtain by interrogation.

As discussed above, interrogation by a formation member may begin when RAs are to be coordinated (e.g., RAs between the formation member and a formation nonmember). Interrogation may begin using TCAS II power levels (610). When the SCA subsystem determines that the host aircraft was flying in a relatively high traffic density ATC environment and is now flying in a relatively low traffic density ATC environment, interrogation using TCAS I power levels (620) may revert to interrogation using TCAS II power levels (610). Interrogation using TCAS I power levels (620) may begin when the SCA subsystem of a formation member begins operating in an active mode when in a relatively high density ATC environment and no RAs are pending. In a preferred mode of operation for a formation member, the collision avoidance algorithms distinguish between the nearby formation members and nonmember traffic. By distinguishing other formation members from nonmembers, TAs and RAs against other formation members are not presented.

In method 500, discussed above, the determination (530, 535) of whether a threat exists may be made when a threshold altitude and range to an intruder exceeds a threshold; or when a time to closure in altitude or range of the intruder is less than a threshold (e.g., likely to be insufficient time to avoid collision). Altitude and range may be obtained from network surveillance information by an SCA subsystem operating in a passive mode. These thresholds may be dynamically set by processor 410 (or processor 484) based on factors that include for the formation member aircraft: the current speed, altitude, and vertical speed. These thresholds may be set by manual operation, initialization, configuration, or design, for example, 850 feet altitude, 1 nm from intruder to penetration of host aircraft TA region, and 45 seconds (e.g., a TA threshold as in DO185A). The warning of a threat provided to the pilot or flight crew 550 may be an audible and/or visual warning that provides data describing the nonmember associated with the threat. This data may include, but is not limited to, an estimated closure time of the nonmember and/or a distance to the nonmember.

When an RA is to be provided (540) by a formation member's SCA subsystem operating in a passive mode (730), the SCA subsystem is preferably begins operating (735) in an active mode so that RAs may be coordinated between individual members of the formation, if necessary, and between formation members and nonmembers.

The collision avoidance algorithms of each formation member's SCA subsystem preferably track identification and position of each aircraft in the formation using SKE data exchanged over the wireless communication link or using ADS-B information. This is desirable to prevent a formation member's SCA subsystem from generating an RA to avoid a collision with a nonmember wherein the RA conflicts with flight paths of other formation members. Tracking formation members is also important to prevent RAs from being generated against other members of the formation as discussed above.

Surveillance and Collision Avoidance of Formation Members

Conventional SKE provides surveillance with regard only to similarly equipped SKE aircraft. As described above, a communication link (e.g., SKE link) may be used with an SCA subsystem. For example a formation member's SCA subsystem operating in a passive mode may use information from such a communication link to track and perform collision avoidance calculations on nearby nonmembers.

In another embodiment of the present invention, network surveillance information may be used to monitor nonmembers and to monitor other members of the formation. Formation members may have SKE or ADS-B systems for such monitoring. In addition to monitoring nonmembers, the surveillance and collision avoidance methods and systems in this embodiment process available SKE and ADS-B information to continually track other formation members on the same traffic display as the tracked nonmembers. This information may also be used to determine whether collision threats exist between formation members.

On determining (740) that a threat exists between the host aircraft and another formation member, the host aircraft SCA subsystem preferably generates (745) an encroachment advisory rather than a resolution advisory. The presentation (545) or provision (550) of an encroachment advisory may include audio and/or video indicia that inform the pilot of the host aircraft flying as a formation member. The pilot of the other formation member aircraft may also be informed by a locally generated encroachment advisory.

There may be two types of encroachment advisories: (a) an encroachment proximity alert; and (b) an encroachment acceleration alert. An encroachment proximity alert occurs when a minimum threshold distance ($N_{th}$) between two formation members is reached (e.g., Distance to another formation member <($N_{th}$) ft.), or when a time to penetration Tau ($\tau$) of a minimum threshold distance is reached (e.g., time until another formation member reaches minimum threshold distance <($\tau$)). In one implementation, ($N_{th}$) is 1000 ft. and ($\tau$) is 30 seconds.

An encroachment acceleration alert occurs when relative acceleration of a formation member within a certain distance of another formation member exceeds a certain amount ($g_b$). For example, two formation members within 1000 ft of each other may have a threshold acceleration limit ($g_b$) of 0.3 g. This means that when an acceleration of a first member of the formation is greater than 0.3 g relative to the acceleration of a second formation member that is within 1000 ft of the first formation member, an encroachment acceleration alert will inform the pilots of the first and second aircraft of the potential danger.

The determination that an encroachment advisory is to be provided in a host aircraft may be communicated to the encroaching aircraft as network surveillance information. When either of these encroachment advisories are presented, the formation member aircraft pilots preferably take steps to resolve the threat.

A method for operating in a passive mode, according to various aspects of the present invention, provides surveillance and collision avoidance. Such a method may be performed by an SCA subsystem of a host aircraft flying as a formation member. A system for surveillance and collision avoidance for aircraft flying in formation flight may include a subsystem for providing network surveillance information as discussed above (e.g. by a formation leader) and a subsystem for performing a method using network surveillance information (e.g., by a formation member). For example, method 540 of FIG. 7 includes operations performed by a formation member that is part of such a system. An SCA subsystem (e.g., 480) operating in a passive mode receives (523) network surveillance information and/or ADS-B information to monitor formation nonmembers and formation members. For example, monitoring of nonmembers is performed by evaluating information received from the communication link (network surveillance information) from one or more formation members having SCA subsystems operating in an active mode (e.g., 402). Information about nearby aircraft may also be obtained by receiving squittered information (e.g., ADS-B) from the nearby aircraft. Information to monitor other formation members is received via the communication link between formation members (e.g., SKE information) or received as ADS-B information broadcast by the formation aircraft that are so equipped.

If a particular formation member does not have SKE or ADS-B, this particular formation member may provide its position and identification information in reply to interrogations it receives from other formation members that are operating in an active surveillance mode. This information may then be communicated from this particular formation member to other formation members using the communication link. By using the communication link, this particular formation member may continue operating in a passive mode.

Subsystems operating in a passive mode update (545, 550) cockpit traffic displays to display current traffic conditions based on information received (523) as discussed above. The displayed traffic may include identification of the nearby traffic (e.g., distinguishing between formation members, other aircraft, and ground vehicles), the respective positions of the nearby traffic, and other information indicating dynamic properties of the nearby aircraft (e.g., altitude, vertical speed, etc.).

If (535) a subsystem operating in a passive mode determines (540) that any traffic advisory or resolution advisory is to be raised against a nonmember (730), operation in a passive mode ceases (735) and further operation continues (e.g., automatically) in an active mode. Whether TAs or RAs are to be raised may be determined using any information received (523) as discussed above. TAs and RAs are indicated (545, 550) to a pilot by visual and/or aural means. If a TA or RA is presented, the pilot may manually switch (735) to an active mode of operation in a subsystem where automatic mode change is not enabled for this situation. Continued surveillance in an active mode is preferably performed in accordance with power levels discussed above with reference to FIG. 6. After the conflict is resolved (e.g., no TA or RA is being maintained or provided), operation may revert to a passive mode.

Any suitable display indicia may be used in the presentation of TAs and RAs to the pilot on a traffic display. For example, when a TA or RA is raised against a particular aircraft, the symbol corresponding to that aircraft on the presentation may be modified in shape, color, or both shape and color; additional text may be associated with the symbol; or a combination of shape, color, and text may be used.

The SCA subsystem operating in a passive mode also checks (530) for threats between formation members based on information received (523) as discussed above. If (740) a threat of collision between the host aircraft and another formation member exists, an encroachment advisory, preferably of the type discussed above, may be issued (745) to the pilot or flight crew. The pilot resolves the encroachment condition and the subsystem continues to operate in a passive mode.

Figure 5:
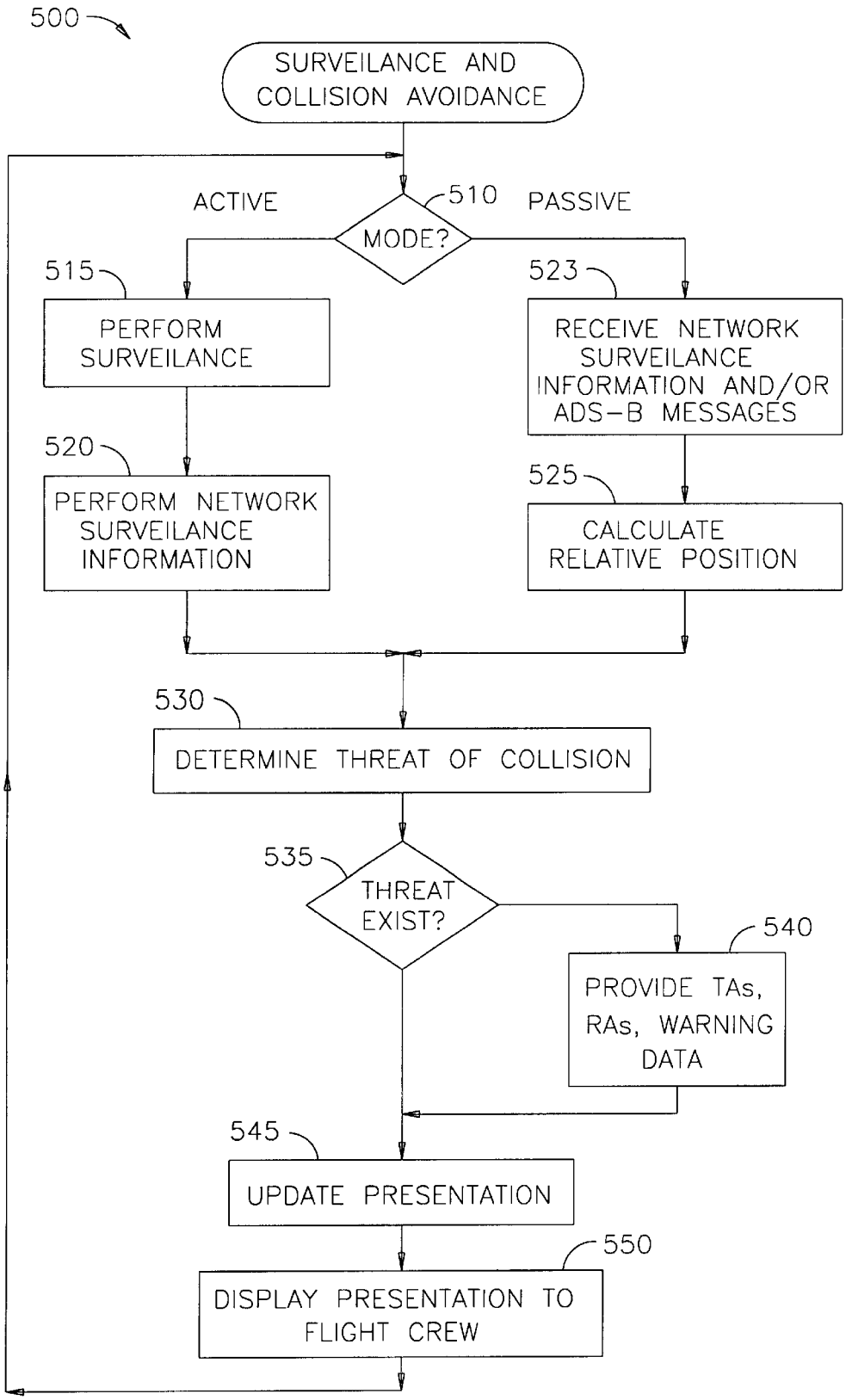
FIG. 5 is a flow chart of a method for surveillance and collision avoidance according to various aspects of the present invention.
Figure 6:
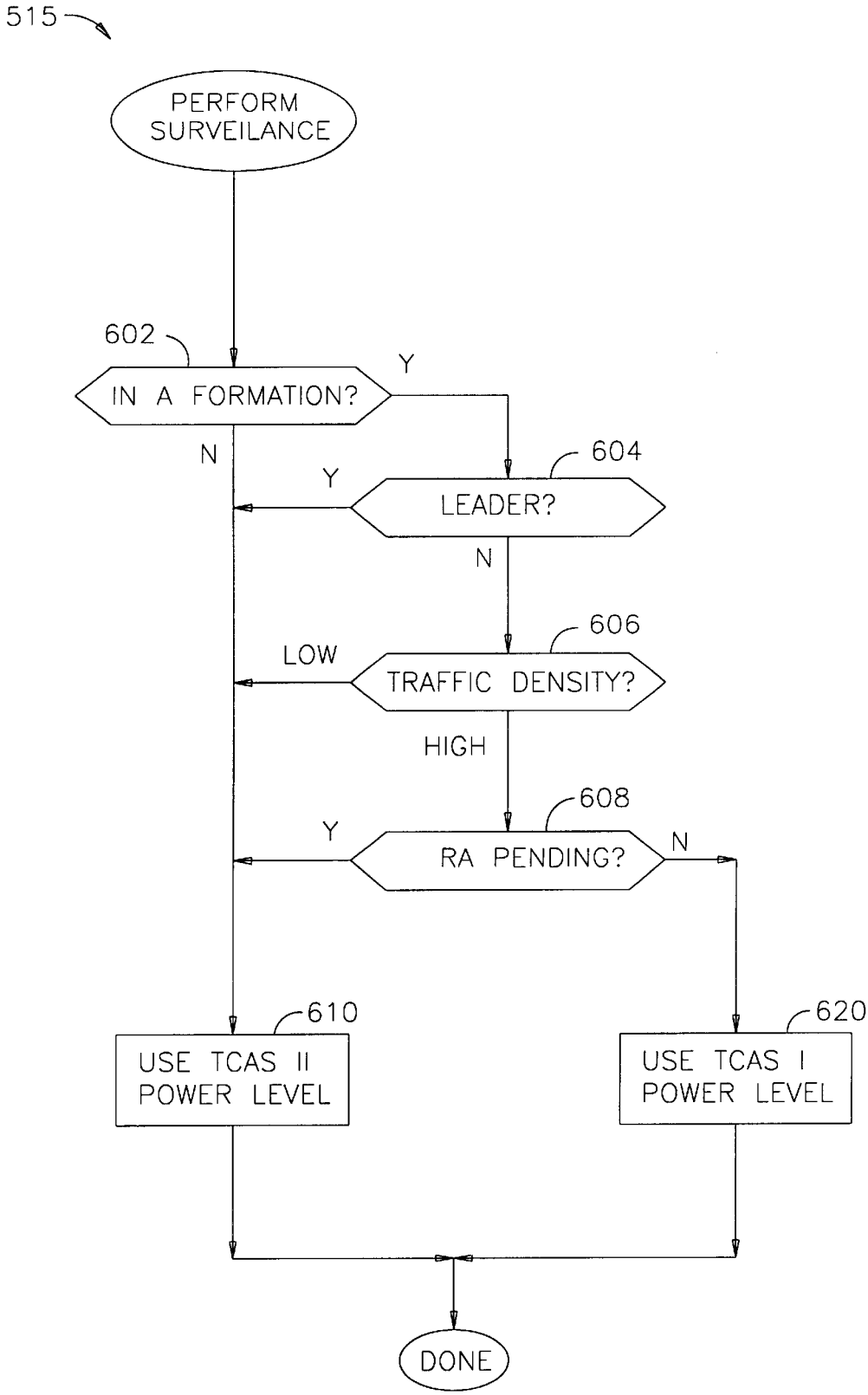
FIG. 6 is a flow chart of a method for performing surveillance in the method of FIG. 5.
Figure 7:
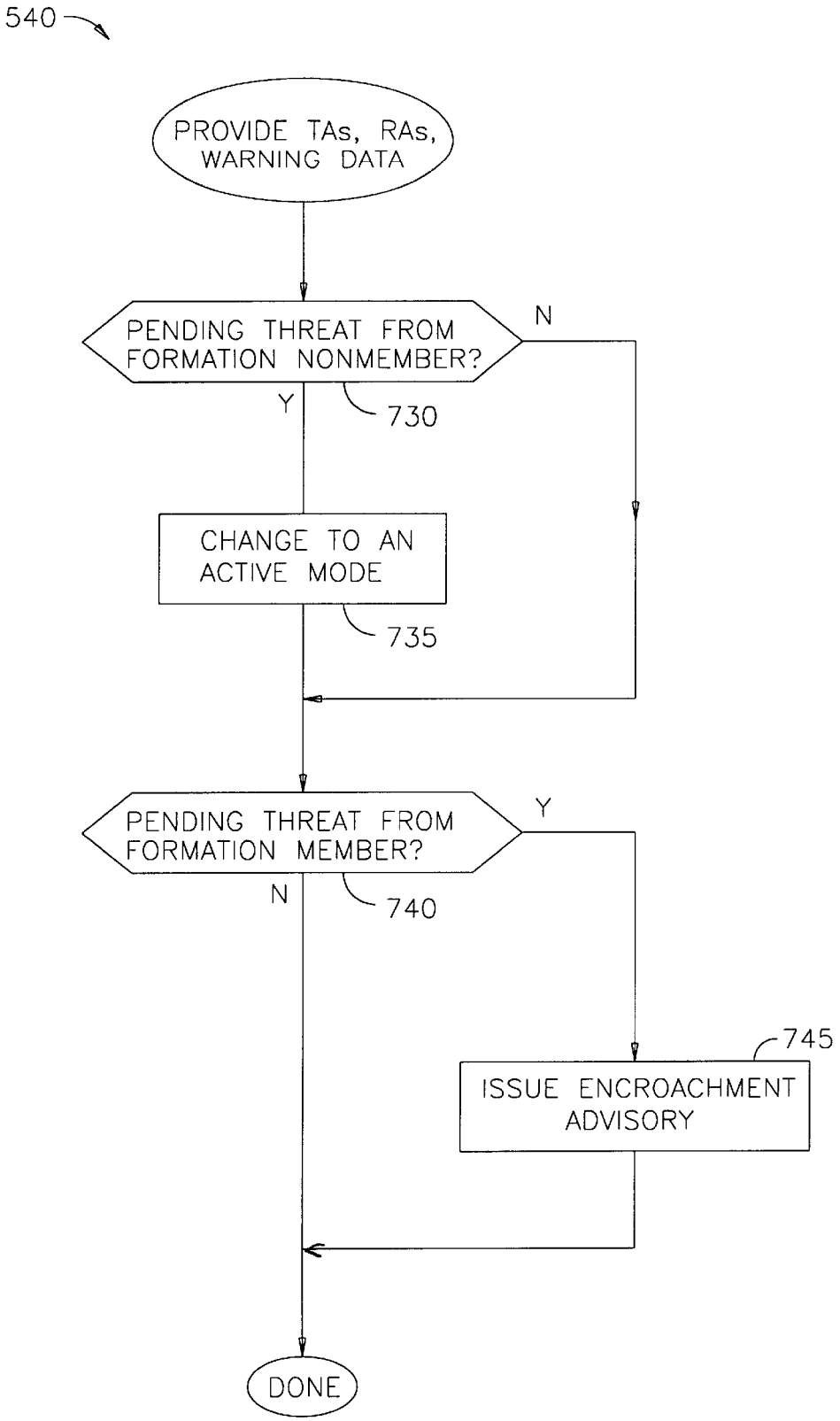
FIG. 7 is a flow chart of a method for providing TAs, RAs, and warning data in the method of FIG. 5.

While FIGS. 5–7 illustrate using a sequential diagram an implementation of methods discussed above, the skilled artisan will recognize that the functions performed in these methods may be performed in any sequence, concurrently with one another, and/or more than once. For example, updating (545, 550) the traffic display may be continuously and periodically performed throughout execution of method 500.

A surveillance and collision avoidance system or air traffic management system, in alternate embodiments according to various aspects of the present invention, has subsystems that operate selectively in an active mode as discussed above or in an autonomous passive mode. Each such subsystem is herein called an SCAA subsystem. A system in one implementation includes all SCAA subsystems while an alternative has a mix of SCA and SCAA subsystems.

An SCAA subsystem operating in an active mode transmits interrogations of the type described as TCAS interrogation signals (e.g., ATCRBS interrogations) to solicit replies from the transponders of nearby traffic. Formation members having SCAA subsystems operating in an active mode, however, do not communicate surveillance information via a network to other formation members as with SCAs discussed above.

An SCAA performs tracking and provides collision avoidance advisories (e.g., TAs or RAs) in accordance with unsolicited received signals (e.g., squitters) without information received via a network among formation members. An SCAA operating in a passive mode may in addition eavesdrop on the replies to interrogations that originate from other aircraft. An SCAA operating in a passive mode is not transmitting interrogations of the type described above as TCAS interrogation signals (e.g., received by ATCRBS and MODE S transponders). However, SCAA subsystems operating in a passive mode may transmit and/or receive signals in various protocols compatible with SKE (Station Keeping Equipment), ADS-B (Automatic Dependent Surveillance-Broadcast), TIS-B (Traffic Information Service Broadcast), and/or squitter signals. In a preferred implementation, tracking in a passive mode relies exclusively on tracking information from received unsolicited ADS-B and MODE S messages. For example, unsolicited ADS-B messages may be used to track targets that are formation members.

Tracking information for a target that is received in a passive mode is periodically validated by comparing it to tracking information that is received or determined from another source. Tracking information for a target may include latitude, longitude, altitude air speed, flight identification, Mode S address, ground speed, and intent of the target as well as information relative to the host aircraft such as range, relative altitude, and relative bearing. Sources include ADS-B messages, Mode S messages, and ATCRBS responses. Validation may occur: (a) when a source exceeds a threshold level of reliability (e.g., suitable signal strength, or number of errors detected over time below a predetermined number); (b) repeatedly at intervals between 0.5 to 2.5 minutes (regular or irregular), preferably regularly every 2 minutes; or (c) repeatedly at intervals of from 6 to 15 seconds (regular or irregular), preferably regularly every 10 seconds. A brief period of interrogation of a target may be used to collect data for validating data regarding that target received from another source. Repeated validation may begin when the target seems closer than predetermined limits in range (e.g., from 1 nmi to 5 nmi, preferably 3 nmi) or altitude (e.g., from 1,000 ft to 10,000 ft, preferably 3000 ft) or is closing in range or altitude such that the target is predicted to be closer than the predetermined range or altitude within an ensuing period of time (e.g., from 30 sec to 90 sec, preferably 60 sec).

An automatic transition from a passive mode to an active mode may occur in response to failing one or a predetermined number of validation comparisons; or when the target seems closer than predetermined limits in both range (e.g., from 1 nmi to 5 nmi, preferably 3 nmi) and altitude (e.g., from 1,000 ft to 10,000 ft, preferably 3000 ft) or is closing in range and altitude such that the target is predicted to be closer than the predetermined range or altitude within an ensuing period of time (e.g., from 30 sec to 90 sec, preferably 60 sec). A target may be providing data from more than one source. For example, a target equipped with an ADS-B capable Mode S transponder may be transmitting its position in ADS-B extended squitters, and responding to TCAS interrogations while one or more ATC ground stations are also broadcasting TIS-B messages containing the target position derived from the target ATCRBS or Mode S replies to ATC interrogations.

Tracking in an active mode may rely on information received via ATCRBS responses and/or via Mode S messages. Active tracking may occur for either civil or military aircraft under any of several circumstances including: (a) when surveillance information is not being received for the target (e.g., the target is not ADS-B capable, is not transmitting ADS-B, and no network surveillance information is being received for the target); (b) the surveillance information received without interrogation of the target failed a validation test; and (c) the target is a civil aircraft within the region for active tracking.

Interrogation power may be reduced in response to traffic density. For example, maximum transmitted power for an interrogation may be reduced 1 dB to 27 dB from full power, preferably 10 dB from full power in an environment with traffic density of 20 to 30 transponder-equipped aircraft (e.g., having an operating TCAS, SCA, or SCAA) within 30 nmi. This reduction in transmitted power (and a suitable increase in receiver sensitivity) may be in addition to reduction in power for purposes of interference limiting as discussed above and in DO 185A. Traffic density is determined by a comparing the number of aircraft in the airspace surrounding the host aircraft to a limit. In one implementation, an assessment of traffic density is made by counting the number of transponder-equipped aircraft (e.g., having an operating TCAS, Mode S transponder, SCA, or SCAA) in the receive range of the host aircraft's receiver (i.e., TCAS, Mode S transponder, SCA, or SCAA). In another implementation the assessment is made by counting the current number of ATCRBS target tracks. Both techniques may be combined with suitable logic and limits.

In system employing SCAs and/or SCAAs, targets are distinguished on the basis of any of the following: (a) whether the target is airborne or on the ground; (b) whether the target is a civil aircraft, a military aircraft identified as a formation member with the host aircraft, or a military aircraft not identified as a formation member with the host aircraft; (c) whether a ground track for the target is unknown, known by passive surveillance (e.g., as with SCA or SCAA passive modes discussed above) or known by active surveillance; (d) for civil aircraft, whether the target is the subject of no advisory, a traffic advisory, or a resolution advisory; and (e) for a military aircraft, whether the target is the subject of no encroachment advisory, an unintended encroachment advisory, or an intended encroachment advisory. These distinguishing aspects of one or more targets may be made evident to the flight crew in any presentation of situational awareness information.

A presentation of situational awareness information, according to various aspects of the present invention, includes symbols arranged in spatial relation with text associated to one or more of the symbols. Text may include indicia of aircraft identity. Spatial arrangement may indicate a top view of the environment as seen from a point above the host aircraft. For example, the presentation of FIG. 8 includes symbols and text to illustrate a flight scenario having formation members and nonmembers. The presentation of FIG. 8 may be presented, for example, on an integrated display device as discussed above.

Presentation 800 includes a symbol 810 for the host aircraft, symbols 812 and 813 for formation members, and symbols 820 and 830 for aircraft that are not members of the formation. Symbol 810 is centered in presentation 800 and indicates a reference position and heading of the host aircraft. Symbols 812 and 813 are spaced apart from symbol 810 and indicate relative position and relative heading of two aircraft flying in a formation with the host aircraft.

Symbols used in presentation 800 are selected to clearly indicate significant differences among the traffic being described. Differences may be in any combination of shape, size, color, animation, and symbol complexity (e.g., number of elements in a compound symbol). For example, symbols 812 and 813 for formation members are preferably different from symbols 820 and 830 for aircraft that are not members of the formation. The symbols used in presentation 800 may differ to distinguish members (e.g., military) cooperating using SKE, members cooperating using ADS-B (e.g., military or civil), and members cooperating using network surveillance information. Symbols for formation members and nonmembers may differ to indicate a type of surveillance equipment currently operating onboard each aircraft (e.g., SKE only, SKE with transponder, or transponder only). The symbols used in presentation 800 may differ to distinguish members having SCA subsystems operating in an active mode and members having SCA subsystems operating in a passive mode. The symbols used in presentation 800 may differ to distinguish the type of threat, if any, regarding intruding nonmembers and encroaching members.

An SCA subsystem performs surveillance on transponder-equipped aircraft using TCAS signals while SKE performs surveillance on SKE equipped aircraft (e.g., other aircraft in the formation). Utilizing the systems and methods disclosed herein, a combined list of encroaching formation members as identified by SKE signaling and/or TCAS signaling and intruding nonmembers as identified by TCAS signaling may be used to form an integrated presentation wherein an intruder detected by both types of signaling may be presented with one symbol (as opposed to two symbols on the same or different presentations or displays). Instead of presentations having two symbols for the same aircraft, duplicative symbols are eliminated.

In one implementation of the present invention, an SCA subsystem receives formation member tracks from a SKE subsystem and generates an integrated presentation for display of both member and nonmember tracks on a single display. In an alternate implementation, the SKE subsystem receives nonmember tracks from the SCA subsystem and the SKE subsystem forms an integrated presentation of formation member tracks and nonmember tracks for display. In yet another implementation, a presentation subsystem (e.g., comprising a symbol generator) separate from processor 410 and the SKE subsystem receives information from one or both of processor 410 and the SKE subsystem, and forms/updates an integrated presentation for display. In still another implementation, the presentation subsystem is part of a multipurpose display subsystem 420.

Symbols 820 and 830 illustrate aircraft that are not members of the formation (e.g., nonmembers within a range setting indicated by ring 840 of presentation 800.

Generally, all military and civil aircraft are equipped with transponders, but a transponder may be silent (e.g., transmitting disabled). A military aircraft having a transponder with transmitting disabled may be indicated in a presentation as "SKE only".

Mode S transponders have unique identification fields that may also be utilized by the SKE system to identify and display information about formation members that are not transmitting via the transponder a signal format similar to that being transmitted by nonmembers. Indicia in accordance with the value of a Mode S identification field may be displayed adjacent to, on, or near each aircraft symbol. For example, text such as data tags 850 below symbols 812 and 820 indicate aircraft identification from Mode S identifiers. Using Mode S transponder identification fields facilitates uniquely identifying in a standardized identification format, aircraft that are members or nonmembers of a formation regardless of whether such aircraft have transponders with transmitting disabled.

Presentation 800 may include for each aircraft indicia of other data derived from ADS-B or SKE subsystems such as a velocity vector, a cross track error, and an acceleration. Further, presentation 800 any include any conventional feature such as range, bearing, and altitude of any aircraft depicted by a symbol.

A symbol of an aircraft for presentation on a display, according to various aspects of the present invention, may include one or more shapes, colors, and animations selected from a set of shapes, a set of colors, and a set of animations. Such a symbol is herein called a compound symbol. By learning what meaning is associated with each member of a set, a pilot or member of a flight crew may more quickly understand the meaning intended to be conveyed when a compound symbol is presented for situational awareness, traffic advisory, or resolution advisory. For example, each of Tables 1–5 describe one set and provide exemplary values for members of that set. FIGS. 9 and 10 provide example compound symbols of particular combinations of the member values described in Tables 1–5. The symbols and compound symbols discussed herein may be used in any system in which network surveillance information is to be presented.

TABLE 1

| Symbol Fill | Description |
|---|---|
| Thin outlined | A relatively thin line demarcates the perimeter of the symbol. The thin line has color or animation different from either or both of: (a) the color and animation of the space outside the geometric shape of the symbol; and (b) the color and animation of the space inside the geometric shape of the symbol. For example, symbol 944 may use a thin outline on the perimeter of a pentagon shape. A thin outline circle is also called a thin ring. A thin ring may indicate a symbol has been selected by an operator for manipulation of the presentation. |
| Thick outlined | A relatively thick line (as compared to thin outline discussed above) demarcates the perimeter of the symbol. A thick outline may distinguish a color or shape more significant than a thin outline. A thick outline circle is also called a thick ring. |
| Hatched | The interior or the perimeter of the symbol are indicated by any conventional hatched network of lines or colors. |
| Opaque Filled | The interior or the perimeter of the symbol are indicated by any conventional solid color that differs from colors surrounding the symbol or colors of symbols overlaid by the symbol. For example, in symbol 910 circle 911 may be opaque filled including its perimeter so that circle 911 appears to be overlaid on (and so partially obscuring) the interior and perimeter of chevron 912. |
| Translucent Filled | The interior or the perimeter of the symbol are indicated by any conventional solid color that differs from colors surrounding the symbol or colors of symbols overlaid by the symbol. For example, in symbol 910 Circle 911 may be translucent filled including its perimeter so that circle 911 (if yellow) appears to be overlaid on (and so partially discoloring into green) the interior and perimeter of chevron 912 (if blue). |

TABLE 2

| Symbol Surround | Description |
|---|---|
| None | The outermost perimeter of a symbol may distinguish the symbol from the background of the presentation. For example, symbol 934 may include a pentagon perimeter and no surround different from the general background of the presentation (e.g., a black background, a uniformly lit background, a terrain map, a weather map, a wind sheer map, a sonar map). |
| Outlined | The outermost perimeter may be a larger size of the immediately interior perimeter of the same type of geometric shape. A color different from both the outline and the interior of the symbol is used to create the outlined appearance. For example, symbol 944 may include a square cross perimeter 914 outlined by a larger square cross perimeter 945. |
| Surrounded by different symbol | The outermost perimeter may be a larger size than the immediately interior perimeter and of a different type of geometric shape. For example, symbol 910 may include a chevron larger than a circle wherein the chevron is said to surround the circle. Whether or not the fill of the circle differs in appearance from the fill of the chevron results from choices for each symbol from a set as described with reference to Table 1. |

TABLE 3

| Symbol Color | Description |
|---|---|
| White | Used for: (a) information of a normal presentation or of relatively less significance in importance; (b) symbols for traffic that is not a threat and not proximate (e.g., other traffic); and (c) the host aircraft symbol. |
| Cyan | Used for: (a) the host aircraft symbol when not white; (b) formation member symbols; (c) symbols for proximate traffic; and (d) the ring encircling a formation member associated with an intentional encroachment advisory; and (e) symbols for traffic that is not a threat and not proximate (e.g., other traffic) when not white. |
| Amber | Used for: (a) the symbol associated with a current traffic advisory; and (b) the ring encircling a formation member associated with an unintentional encroachment advisory. |
| Red | Used for the symbol associated with a current resolution advisory. |
| Black | Used for the background of a presentation. Used for a symbol that is surrounded by another symbol. |
| Tan | Used for targets (e.g., vehicles and other formation nonmembers) that are on the ground. |

TABLE 4

| Animation | Description |
|---|---|
| None | Information presented without variation in intensity, color, or shape is being presented in a normal manner conveying less significance relative to other information being presented or to be presented. |
| Intensity or color variation | Information presented with variation in intensity (e.g., blink or flicker) or variation in color (same symbol or element presented in a series of different colors) conveys that the information is of special significance (e.g., describes a hazard to be avoided). |
| Alternate symbols | A symbol or an element of a compound symbol may be presented and updated to dynamically reflect changes in tracking information and information derived from tracking information. For example, a change in the appearance of a symbol without change in the position of the symbol relative to the host may be made in response to a change in flight formation role (e.g., leader, member, or nonmember), a protocol used for acquiring surveillance data (e.g., ADS-B, Mode S, TIS-B, or network surveillance information), a mode of the target's SCA subsystem operation (e.g., whether the current mode is an active or a passive mode), threat (e.g., none (other traffic), proximate traffic, traffic advisory, resolution advisory, unintentional encroachment advisory, intentional encroachment advisory), or a level of significance (e.g., unselected, or selected (e.g., for other presentation detail or presentation functions)). |
| Animated sequence of symbols and/or positions | Information presented with alternating or sequential changes to intensity, color, shape, number of elements, or position relative to the host symbol may indicate: (a) a predicted trajectory of a threat relative to the host aircraft position, or (b) relatively greater significance (e.g., a spinning symbol, or a symbol having one or more elements animated). Changes to intensity, color, or shape may be to a compound symbol as a whole or to one or more elements of a compound symbol. |

TABLE 5

| Symbol Shape | Description |
|---|---|
| Pentagon | A surface target (e.g., a vehicle incapable of flight, a movable object, or a temporary obstruction) on the ground. |

TABLE 5-continued

| Symbol Shape | Description |
|---|---|
| Diamond | A nearby target that is not a threat or potential threat (e.g., proximate traffic). For example, an aircraft that is within 1200 feet altitude and 6 nm range of the host aircraft. |
| Chevron | A target: (a) that has been associated with received ADS-B messages identified to the target; and (b) for which a ground track has been determined. The chevron may be oriented to indicate the target's direction of travel. |
| Square cross | A target: (a) that has been associated with received ADS-B messages identified to the target or has an SCA or SCAA subsystem operating in a passive mode; and (b) for which a ground track has not been determined. |
| Square | A target which is the subject of a current resolution advisory. |
| Circle | When used as a noncompound symbol, indicates a target which is the subject of a current traffic advisory. When used in a compound symbol surrounded by another symbol, may be used to indicate: (a) that the associated target is a formation member; and/or (b) that the associated target has an SCA or SCAA subsystem operating in a passive mode. When used in a compound symbol as a ring, may indicate (a) that the encircled symbol is a target that is the subject of an intentional or unintentional encroachment advisory; or (b) that the symbol has been selected by an operator as the subject of additional presentation detail. |

Preferred combinations of the foregoing sets as described in Table 6 may be used in addition to conventional symbols (e.g., TCAS symbols) to depict vehicles, objects, and aircraft in any presentation, for example, a presentation of traffic situation awareness information. The compound symbols described in Table 6 may be used for targets tracked by an SCA or SCAA subsystem. Such a presentation may be presented on any display, such as a cockpit display, as discussed above.

TABLE 6

| Compound Symbol | Description |
|---|---|
| Symbol 910 having cyan opaque filled chevron 912, black opaque filled circle 911 | Indicates an airborne military target from which ADS-B messages are being received sufficient to passively maintain a ground track. ADS-B messages are being received from a transponder-equipped military aircraft. The unsolicited received messages (e.g., squitters) having position data have been validated against relative position and relative range (e.g., the target is within range for active interrogation). Relative to the host aircraft, the target's position and the range from the host to the target are being determined from direction and time of arrival of solicited replies (e.g., replies to TCAS Mode S interrogations). After validation, unsolicited received ADS-B messages having position data (e.g., target's GPS data) are being used to passively update a track for the target. A presentation for the pilot of the host aircraft shows the host and symbol 910 in relative position according to current position from the track. The chevron is oriented to indicate the direction of travel of the target. The target has been identified as a formation member. |
| Symbol 914 having cyan opaque filled square cross 916, black opaque filled circle 915 | Indicates an airborne military target from which ADS-B messages are being received. ADS-B messages are being received from a transponder-equipped military aircraft. The unsolicited received messages (e.g., squitters) having position data have been validated against relative position and relative range (e.g., the target is within range for active interrogation). Relative to the host aircraft, the target's position and the range from the host to the target are being determined from direction and time of arrival of solicited replies (e.g., replies to periodic |

TABLE 6-continued

| Compound Symbol | Description |
|---|---|
| | TCAS Mode S interrogations). After validation, unsolicited received ADS-B messages having relative position data (e.g., target's GPS data) are being used to passively update a track for the target, however, received ADS-B data does not include information sufficient to determine a target track. Alternatively, this symbol indicates that the target has an SCA or SCAA subsystem operating in a passive mode. A presentation for the pilot of the host aircraft shows the host and symbol 914 in relative position according to current position from the track. The target has been identified as a formation member. |
| Symbol 918 having cyan opaque filled diamond 920, black opaque filled circle 919 | Indicates an airborne military target from which ADS-B messages having position data are not being received. Relative to the host aircraft, the target's position and the range from the host to the target are being determined from direction and time of arrival of solicited replies (e.g., replies to periodic Mode S or ATCRBS interrogations). Relative position data are being used to actively update a track for the target. A presentation for the pilot of the host aircraft shows the host and symbol 914 in relative position according to current position from the track. The target has been identified as a formation member. |
| Symbol 922 having amber thick ring 923, cyan opaque filled chevron 912, black opaque filled circle 911 | Indicates a target of the type discussed above with reference to symbol 910 that is the subject of an unintentional encroachment advisory. The alert (e.g., caution or warning) is enabled when the relative range from the host to the target is less than a separation threshold range; or the target to host closure rate is predicted to violate the separation threshold range within a period of time used for such an alert. |
| Symbol 926 having amber thick ring 927, cyan opaque filled square cross 916, black opaque filled circle 915 | Indicates a target of the type discussed above with reference to symbol 914 that is the subject of an unintentional encroachment advisory. The alert (e.g., caution or warning) is enabled when the relative range from the host to the target is less than a separation threshold range; or the target to host closure rate is predicted to violate the separation threshold range within a period of time used for such an alert. |
| Symbol 930 having amber thick ring 931, cyan opaque filled diamond 920, black opaque filled circle 919 | Indicates a target of the type discussed above with reference to symbol 918 is the subject of an unintentional encroachment advisory. The alert (e.g., caution or warning) is enabled when the relative range from the host to the target is less than a separation threshold range; or the target to host closure rate is predicted to violate the separation threshold range within a period of time used for such an alert. |
| Symbol 922 having cyan thick outlined circle 923, cyan opaque filled chevron 912, black opaque filled circle 911 | Indicates a target of the type discussed above with reference to symbol 922 except that an intentional encroachment advisory applies (e.g., the target and host aircraft are performing a rendezvous or refueling operation). |
| Symbol 926 having cyan thick ring 927, cyan opaque filled square cross 916, black opaque filled circle 915 | Indicates a target of the type discussed above with reference to symbol 914 except that an intentional encroachment advisory applies. |
| Symbol 930 having cyan thick ring 931, cyan opaque filled diamond 920, black opaque filled circle 919 | Indicates a target of the type discussed above with reference to symbol 918 except that an intentional encroachment advisory applies. |
| Symbol 934 having tan thin outlined pentagon | Indicates a surface vehicle or object from which ADS-B messages are being received. The vehicle or object is not transponder equipped. The unsolicited received ADS-B messages (e.g., squitters) have position data (e.g., target's GPS data) that is being used to passively update a track for the target. A presentation for the pilot of the host aircraft shows the host and symbol 910 in relative position according to current position from the track. |
| Symbol 940 having cyan thick outlined chevron 941, cyan opaque filled chevron 912, black opaque filled circle 911 | Indicates a target of the type discussed above with reference to symbol 910 has been selected by an operator as the subject of additional presentation detail. |
| Symbol 944 having cyan thick outlined square cross 945, cyan opaque filled square cross 916, black opaque filled circle915 | Indicates a target of the type discussed above with reference to symbol 914 has been selected by an operator as the subject of additional presentation detail. |
| Symbol 948 having cyan thick outlined diamond 949, cyan opaque filled diamond 920, black opaque filled circle 919 | Indicates a target of the type discussed above with reference to symbol 918 has been selected by an operator as the subject of additional presentation detail. |
| Symbol 952 having amber thick outlined circle 953, cyan thin outlined chevron 941, cyan opaque filled chevron 912, black opaque filled circle 911 | Indicates a target of the type discussed above with reference to symbol 922 has been selected by an operator as the subject of additional presentation detail. |
| Symbol 956 having amber thick outlined circle 957, cyan thin outlined square cross 945, cyan opaque filled square cross 916, black opaque filled circle 915 | Indicates a target of the type discussed above with reference to symbol 926 has been selected by an operator as the subject of additional presentation detail. |
| Symbol 960 having amber thick outlined circle 961, cyan thin outlined diamond 949, cyan opaque filled diamond 920, black opaque filled circle 919 | Indicates a target of the type discussed above with reference to symbol 930 has been selected by an operator as the subject of additional presentation detail. |
| Symbol 964 having tan thin outlined pentagon 965, tan thin outlined pentagon 934 | Indicates a target of the type discussed above with reference to symbol 934 has been selected by an operator as the subject of additional presentation detail. |

Figure 11:
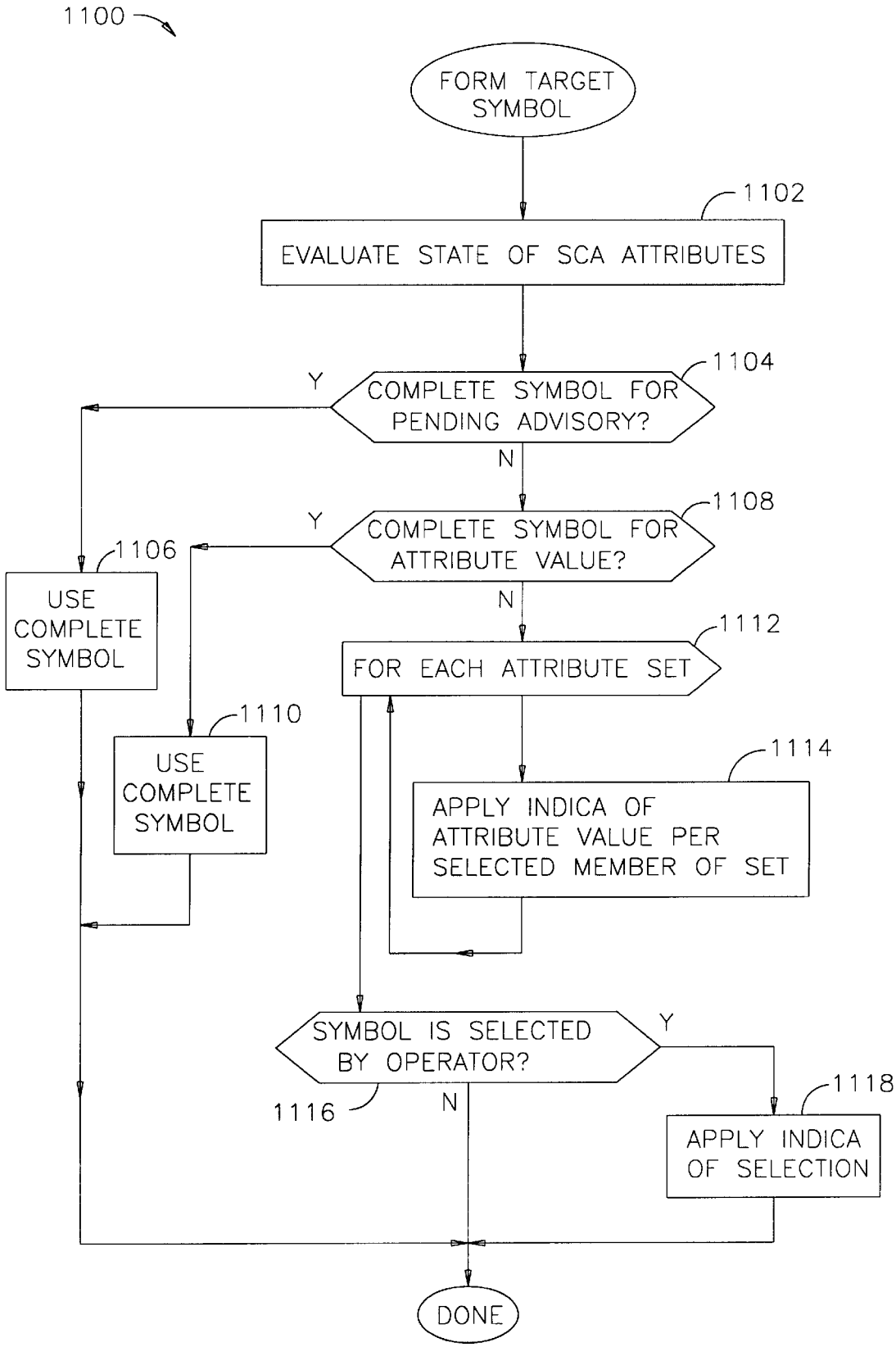
FIG. 11 is a flow chart of a method for forming a target symbol.

A method, according to various aspects of the present invention, forms a presentation having a symbol for each of several targets, each symbol being a respective compound or noncompound symbol. Each symbol graphically and symbolically describes one or more attributes of surveillance and collision avoidance associated with the target. When the value of an attribute changes, one or more features of the symbol (e.g., an element of a compound symbol) is updated. For example, method 1100 of FIG. 11, performed by processor 410 and/or 484 when a presentation is to be formed or updated, begins by evaluating (1102) attributes of the current surveillance and collision avoidance methods and results. If (1104) an advisory is pending and the advisory is associated with a complete symbol, the symbol associated with the advisory is used (1106) (e.g., a red square for an RA against any target). If (1108) an attribute associated with the target defines a complete symbol the complete symbol is used (1110) provided that the attribute currently has a suitable value (e.g., a target squittering ADS-B with indicia of a ground vehicle is represented with the ground vehicle symbol). Otherwise, a compound symbol is prepared as follows.

For each attribute of the current surveillance and collision avoidance methods and results that is associated with the target and defines one respective member of one or more sets (1112), select (1114) the member from each set to define one or more elements of the compound symbol. The foregoing selection function (1114) is repeated until all attributes of the current surveillance and collision avoidance methods and results have been considered. Selected member criteria may be applied to the compound symbol being formed by way of adding to, revising, or deleting prior selected member criteria. For example, radio interference may temporarily block communication with the target and/or block reception of network surveillance information; during the block in communication, the current state of the communication protocol may revert to another protocol or to "no current protocol"; and symbolic indicia of the former communication protocol and/or network status may be removed or replaced. For instance, when a target's SCA subsystem reverts to active mode, its status as a formation member may revert to nonmember, and indicia of mode and membership (e.g., a black circle 911 interior to all other elements of the symbol 910) may be omitted from the target symbol presentation until reversion to passive mode and establishment of a link for exchange of network surveillance information.

Finally, if (1116) the target symbol as defined above is designated as selected for further presentation operations, a further element connoting selection is applied (1118) to the compound symbol.

Unless contrary to physical possibility, the inventors envision the methods and systems described herein: (a) may be performed in any sequence and/or combination; and (b) the functions of respective embodiments to be combined in any packaged components. Functions discussed above as being implemented as processes or by processors may be automated in any conventional manner including being implemented as software stored in a memory device (e.g., semiconductor circuitry, disk, or removable media) and executed by a computer circuit. A meaning described above as associated with a particular geometric shape may be conveyed in alternate implementations by a different geometric shape. For example, the circle used to indicate a formation member or the ring to indicate an encroachment advisory may be implemented as any geometric shape (e.g., a square). Further, the ring to indicate an encroachment advisory may be implemented as any thick or thin outline as defined above.

Although there have been described preferred embodiments of this novel invention, many variations and modifications are possible. The invention described herein is not limited by the specific disclosure above, but rather should be limited only by the scope of the appended claims.

What is claimed is:

1. A method for forming a presentation for a host pilot's situational awareness of a target, the method performed by a collision avoidance subsystem, the method comprising:

a step for tracking the target to provide tracking information;

a step for determining whether the target is a member of a formation; and a step for determining a symbol for the target comprising first indicia of how the target is being tracked and second indicia of whether the target is a formation member, the symbol for presentation in accordance with the tracking information.

2. The method of claim 1 wherein the second indicia is at least partially interior to the first indicia.

3. The method of claim 1 wherein the second indicia comprises a circle.

4. The method of claim 3 wherein the circle appears opaque and filled.

5. The method of claim 1 wherein the first indicia comprises at least one of a square cross and a chevron.

6. The method of claim 1 wherein the step for tracking comprises a step for deriving an item of tracking information from a received ADS-B squitter.

7. The method of claim 1 wherein the step for tracking comprises a step for validating tracking information received in a passive mode with tracking information received in response to interrogation.

8. The method of claim 1 wherein the step for determining whether the target is a member of a formation comprises a step for comparing an item of tracking information from a received ADS-B squitter with stored indicia of formation membership.

9. The method of claim 1 further comprising a step for determining an encroachment advisory regarding the target from the tracking information, the encroachment advisory comprising a compound symbol, for presentation in place of the symbol, the compound symbol comprising the symbol and indicia of the encroachment advisory.

10. The method of claim 9 wherein the indicia of encroachment advisory comprises a ring surrounding the symbol.

11. The method of claim 9 wherein the indicia of encroachment advisory comprises a first color if the encroachment is deemed intentional and otherwise a second color.

12. A memory device comprising indicia of instructions for use by a processor to perform the method of claim 1.

13. An apparatus for collision avoidance comprising:

means for tracking a target to provide tracking information;

means for determining whether the target is a member of a formation; and means for determining a symbol for the target comprising first indicia of how the target is being tracked and second indicia of whether the target is a formation member, the symbol for presentation in accordance with the tracking information.

14. The apparatus of claim 13 wherein the second indicia is at least partially interior to the first indicia.

15. The apparatus of claim 13 wherein the second indicia comprises a circle.

16. The apparatus of claim 15 wherein the circle appears opaque and filled.

17. The apparatus of claim 13 wherein the first indicia comprises at least one of a square cross and a chevron.

18. The apparatus of claim 13 wherein the means for tracking comprises a means for deriving an item of tracking information from a received ADS-B squitter.

19. The apparatus of claim 13 wherein the means for tracking comprises a means for validating tracking information received in a passive mode with tracking information received in response to interrogation.

20. The apparatus of claim 19 further comprising means for determining an encroachment advisory regarding the target from the tracking information, the encroachment advisory comprising a compound symbol, for presentation in place of the symbol, the compound symbol comprising the symbol and indicia of the encroachment advisory.

21. The apparatus of claim 20 wherein the indicia of encroachment advisory comprises a ring surrounding the symbol.

22. The apparatus of claim 20 wherein the indicia of encroachment advisory comprises a first color if the encroachment is deemed intentional and otherwise a second color.

23. The apparatus of claim 13 wherein the means for determining whether the target is a member of a formation comprises means for comparing an item of tracking information from a received ADS-B squitter with stored indicia of formation membership.

24. A method for forming a presentation for a host pilot's situational awareness of a target, the method performed by a collision avoidance subsystem, the method comprising:

tracking the target to provide tracking information;

determining whether the target is a member of a formation; and determining a symbol for the target comprising first indicia of how the target is being tracked and second indicia of whether the target is a formation member, the symbol for presentation in accordance with the tracking information.

25. The method of claim 24 wherein the second indicia is at least partially interior to the first indicia.

26. The method of claim 24 wherein the second indicia comprises a circle.

27. The method of claim 26 wherein the circle appears opaque and filled.

28. The method of claim 24 wherein the first indicia comprises at least one of a square cross and a chevron.

29. The method of claim 24 wherein tracking comprises deriving an item of tracking information from a received ADS-B squitter.

30. The method of claim 24 wherein tracking comprises validating tracking information received in a passive mode with tracking information received in response to interrogation.

31. The method of claim 24 wherein determining whether the target is a member of a formation comprises comparing an item of tracking information from a received ADS-B squitter with stored indicia of formation membership.

32. The method of claim 24 further comprising determining an encroachment advisory regarding the target from the tracking information, the encroachment advisory comprising a compound symbol, for presentation in place of the symbol, the compound symbol comprising the symbol and indicia of the encroachment advisory.

33. The method of claim 32 wherein the indicia of encroachment advisory comprises a ring surrounding the symbol.

34. The method of claim 32 wherein the indicia of encroachment advisory comprises a first color if the encroachment is deemed intentional and otherwise a second color.

35. A memory device comprising indicia of instructions for use by a processor to perform the method of claim 24.

36. An apparatus for collision avoidance comprising:

a receiver; and a processor coupled to the receiver to track a target and to determine tracking information in accordance with received signals, wherein the processor determines whether the target is a member of a formation, and determines a symbol for the target comprising first indicia of how the target is being tracked and second indicia of whether the target is a formation member, the symbol for presentation in accordance with the tracking information.

37. The apparatus of claim 36 wherein the second indicia is at least partially interior to the first indicia.

38. The apparatus of claim 36 wherein the second indicia comprises a circle.

39. The apparatus of claim 38 wherein the circle appears opaque and filled.

40. The apparatus of claim 36 wherein the first indicia comprises at least one of a square cross and a chevron.

41. The apparatus of claim 36 wherein the processor determines tracking information in accordance with a received ADS-B squitter.

42. The apparatus of claim 36 further comprising an interrogator, wherein the processor validates tracking information received in a passive mode with tracking information received in response to interrogation.

43. The apparatus of claim 42 wherein the processor determines an encroachment advisory regarding the target from the tracking information, the encroachment advisory comprising a compound symbol, for presentation in place of the symbol, the compound symbol comprising the symbol and indicia of the encroachment advisory.

44. The apparatus of claim 43 wherein the indicia of encroachment advisory comprises a ring surrounding the symbol.

45. The apparatus of claim 43 wherein the indicia of encroachment advisory comprises a first color if the encroachment is deemed intentional and otherwise a second color.

46. The apparatus of claim 36 wherein the processor compares an item of tracking information from a received ADS-B squitter with stored indicia of formation membership.

* * * * *